US005107813A

United States Patent [19]

Inoue et al.

[11] Patent Number: 5,107,813

[45] Date of Patent: Apr. 28, 1992

[54] CONTROL APPARATUS OF AN INTERNAL COMBUSTION ENGINE

[75] Inventors: Hitoshi Inoue, Amagasaki; Akira Demizu, Himeji, both of Japan

[73] Assignee: Mitsubishi Denki K.K., Tokyo, Japan

[21] Appl. No.: 703,638

[22] Filed: May 21, 1991

[30] Foreign Application Priority Data

Jul. 6, 1990 [JP] Japan ..... 2-180206

[51] Int. Cl.[5] ..... F02D 41/04; F02P 5/10

[52] U.S. Cl. ..... 123/425; 123/435

[58] Field of Search ..... 123/425, 435; 73/35 KR, 73/35 K, 35 P; 364/431.08

[56] References Cited

U.S. PATENT DOCUMENTS

| | | | |
|---|---|---|---|
| 4,356,551 | 10/1982 | Iwase et al. | 123/425 X |
| 4,549,513 | 10/1985 | Douaud et al. | 123/425 |
| 4,561,401 | 12/1985 | Hata et al. | 123/425 X |
| 4,624,229 | 11/1986 | Matekunas | 123/425 |
| 4,732,126 | 3/1988 | Ikeura et al. | 123/425 |
| 4,892,074 | 1/1990 | Iriyama | 123/425 |
| 4,971,007 | 11/1990 | Gopp et al. | 123/425 |

FOREIGN PATENT DOCUMENTS 61-55349 3/1986 Japan .

*Primary Examiner*—Willis R. Wolfe

*Attorney, Agent, or Firm*—Sughrue, Mion, Zinn, Macpeak & Seas

[57] ABSTRACT

A control apparatus of an internal combustion engine which comprises: a pressure detecting means for detecting an inner cylinder pressure of each cylinder of a plurality of cylinders of the internal combustion engine; a crank angle detecting means for detecting a crank angle of the internal combustion engine; indicated mean effective pressure calculating means for calculating an indicated mean effective pressure of each cylinder from an output of the pressure detecting means and an output of the crank angle detecting means; load detecting means for detecting a load of the internal combustion engine; engine speed detecting means for detecting the internal combustion engine speed from an output of the crank angle detecting means; running condition determining means for determining a running condition of the internal combustion engine from an output of the load detecting means and an output of the engine speed detecting means; and averaging and controlling means for controlling at least one of an air-fuel ration and an ignition timing independently for each cylinder, so that an average value of each indicated means effective pressure of the plurality of cylinders is independently maximized, based on an output of the indicated mean effective pressure calculating means, under a predetermined running condition determined by the running condition determining means.

4 Claims, 26 Drawing Sheets

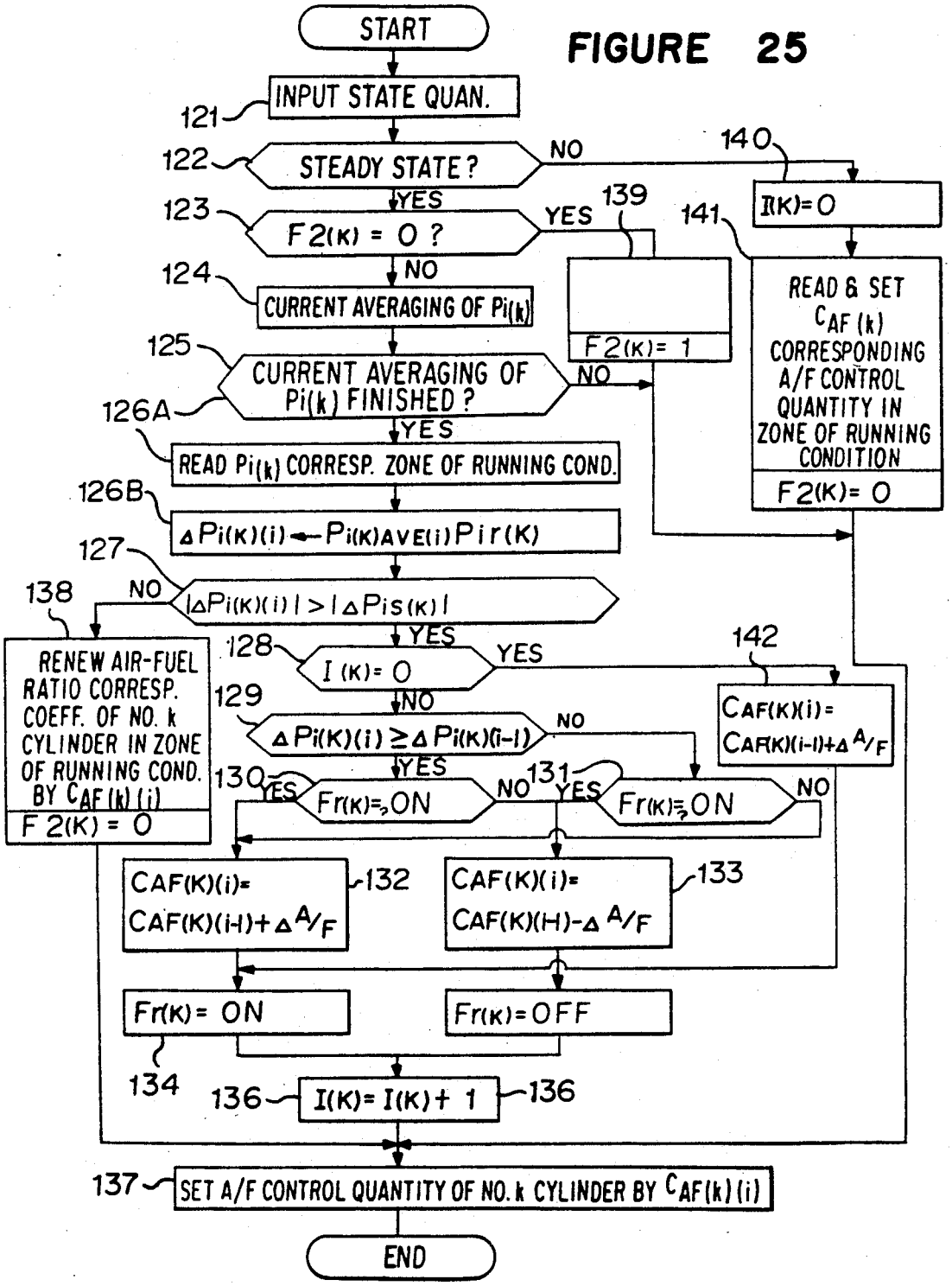
START
FIGURE 25
INPUT STATE QUAN.
121
122
STEADY STATE ?
NO
140
YES
123
F2(K) = 0 ?
YES
139
141
I(K)=0
NO
124
CURRENT AVERAGING OF Pi(k)
F2(K)= 1
READ & SET CAF (k) CORRESPONDING A/F CONTROL QUANTITY IN ZONE OF RUNNING CONDITION
F2(K)= 0
125
CURRENT AVERAGING OF Pi(k) FINISHED ?
NO
126A
YES
READ Pi(k) CORRESP. ZONE OF RUNNING COND.
126B
ΔPi(K)(i) ← Pi(K)AVE(i) Pir(K)
127
138
NO
|ΔPi(K)(i)| > |ΔPis(K)|
YES
RENEW AIR-FUEL RATIO CORRESP. COEFF. OF NO. k CYLINDER IN ZONE OF RUNNING COND. BY CAF(k)(i)
F 2(K) = 0
128
I (K)= 0
YES
142
CAF(K)(i)= CAF(K)(i-1)+Δ A/F
129
NO
ΔPi(K)(i) ≥ ΔPi(K)(i-1)
NO
YES
130
YES
Fr(K)=ON
NO
131
YES
Fr(K)=ON
NO
CAF(K)(i)= CAF(K)(i-1)+Δ A/F
132
CAF(K)(i)= CAF(K)(i-1)-Δ A/F
133
Fr(K)= ON
Fr(K)=OFF
134
136
I(K)= I(K)+ 1
136
137
SET A/F CONTROL QUANTITY OF NO. k CYLINDER BY CAF(k)(i)
END

FIGURE 26

Pir(K)(kg/cm²)

| Suction air quantity Q | 1000 | 2000 | 3000 | 4000 | 5000 | 6000 |
|---|---|---|---|---|---|---|
| 5 | 15 | 17 | 18 | 18 | 19 | 20 |
| 4 | 13 | 14 | 15 | 16 | 18 | 19 |
| 3 | 10 | 11 | 11 | 12 | 14 | 15 |
| 2 | 7 | 8 | 8 | 9 | 10 | 10 |
| 1 | 5 | 6 | 6 | 7 | 8 | 8 |

Engine speed (rpm)

FIGURE 27

CAF(K)

| Suction air quantity Q | 1000 | 2000 | 3000 | 4000 | 5000 | 6000 |
|---|---|---|---|---|---|---|
| 6 | 1.9 | 1.8 | 1.7 | 1.6 | 1.5 | 1.4 |
| 5 | 1.0 | 1.0 | 1.0 | 1.1 | 1.4 | 1.3 |
| 4 | 1.0 | 1.0 | 1.0 | 1.0 | 1.1 | 1.2 |
| 3 | 1.0 | 1.0 | 1.0 | 1.1 | 1.2 | 1.3 |
| 2 | 1.4 | 1.5 | 1.4 | 1.3 | 1.2 | 1.1 |
| 1 | 1.0 | 1.0 | 1.0 | 1.0 | 0.9 | 0.9 |

Engine speed (rpm)

CONTROL APPARATUS OF AN INTERNAL COMBUSTION ENGINE

BACKGROUND OF THE INVENTION

1. Field of the Invention

This invention relates to a control apparatus of an internal combustion engine (hereinafter engine) capable of controlling an air-fuel ratio and/or an ignition timing of a mixture to be supplied to the engine.

2. Discussion of Background

FIG. 30 is a explanatory construction diagram showing an embodiment of a conventional control device of engine. As shown in FIG. 30, fuel is sucked and pressurized by the fuel pump 2 from the fuel tank 1, is stabilized of its pulsation by the fuel damper 3, the particle or moisture of which is removed by the fuel filter 4, the pressure of which is made constant by the pressure regulator 5, and is supplied to the fuel injection valve 6.

A numeral 7 signifies a cold start valve for injecting fuel to improve starting of the engine in a cold place.

Furthermore, air which passes through the air cleaner 8, is measured of its quantity, by the air-flow meter 9, is regulated of its flow quantity by the throttle valve 10, passes through the intake manifold 11, is mixed with fuel (air-fuel mixture) by the fuel injection valve 6, and is transported to the cylinder 12.

This mixture is compressed in the cylinder 12, and ignited by the plug 13 at a pertinent timing. Exhaust gas is discharged to the air through the manifold 14 and a purifier, not shown. A numeral 40 signifies an exhaust gas sensor which detects exhaust gas element concentration, (for instance oxygen concentration).

A numeral 15 signifies a water temperature sensor which detects cooling water temperature, 16, a crank angle sensor incorporated in a distributor for detecting rotation angle of a crank shaft of an engine, 17, an ignition device, and 18, a control device which controls air-fuel ratio of a mixture and ignition timing to be supplied to an engine.

The crank angle sensor 16 outputs a reference position signal at every reference position of crank angle (180° CA for four cylinder engine, and 120° CA for six cylinder engine), and outputs a unit angle pulse at every unit angle (for instance every 2° CA). The current crank angle is known, in the control device 18, by counting the number of the unit angle pulses after the reference position pulse is inputted.

The control device 18 is composed of a microcomputer, consisted of a CPU (central processing unit), a RAM (random access memory), a ROM (read only memory), I/O interface and so on. The control device 18 receives a intake air quantity signal Xl from the above mentioned air flow mater 9, water temperature signal X2 from the water temperature sensor 15, a crank angle signal X3 given by the crank angle sensor 16, an exhaust gas signal X10 from the exhaust gas sensor 40, and a battery voltage signal, not shown, or a signal from a throttle-fully-closed-switch and so on, performs calculation in accordance with these signals, of fuel injection quantity to be supplied to the engine, or valve opening time of the fuel injection valve 6, and outputs an injection signal X5.

By this injection signal X5, the fuel injection valve 6 is operated, and fuel of a predetermined quantity is supplied to the engine.

The calculation of the fuel injection quantity (fuel injection time) $T_1$ in the above control device 18, is performed, for instance by the following equation.

$$T_i = T_p \times (1 + F_t + KMR/100) \times \beta + T_s \quad (1)$$

In the above equation (1), $T_p$ is a basic injection quantity (basic valve opening time). For instance, assuming that an intake air quantity per one rotation is Q, an engine speed is Ne, and K is a constant, $T_p$ is obtained by the following equation.

$$T_p = K \cdot Q / N_e$$

$F_t$ is a correction coefficient which corresponds to the cooling water temperature of the engine, which for instance, becomes a larger value when the cooling water temperature becomes lower.

KMR is a correction coefficient at heavy load time. KMR is read by looking up beforehand a data table in which KMR is described as a value which corresponds with, for instance, a basic fuel injection quantity $T_p$ and the engine speed $N_e$.

$T_s$ is a correction coefficient by a battery voltage. $T_s$ is a coefficient for correcting a variation of an electric voltage which drives the fuel injection valve 6. For instance, assuming that $V_B$ is a battery voltage, and a and b are constants, $T_s$ is obtained by $t_s = a + b\,(14 - V_B)$. Therefore, the lower the battery voltage, the larger the value of $T_s$.

$\beta$ is a correction coefficient which corresponds with exhaust signal X10 from the exhaust gas sensor 40. By using $\beta$, the air-fuel ratio of the mixture can be controlled by a feed back control, to a value near to a predetermined air-fuel ratio, for instance, a theoretical air-fuel ratio 14.8.

However, when the feed back control by the exhaust signal X10 is carried out, the air-fuel ratio is always controlled to a constant value, the above correction by the cooling water temperature or by high load time becomes meaningless.

Therefore, the feed back control by the exhaust air signal X10 is performed only when a correction coefficient for water temperature $F_t$ and the correction coefficient for heavy load time KMR is 0.

On the other hand, as an ignition timing control system of an engine, for instance, a system is described in Japanese Unexamined Patent Publication No. 59061/1982.

In this electronic ignition timing control system, for instance, an optimum ignition advance angle value which corresponds with an engine speed $N_e$ and a basic fuel injection quantity $T_p$, is memorized beforehand in data table. The value of the ignition timing which corresponds to the current engine speed and a basic fuel injection quantity is read out by looking up the table. The ignition signal X6 is outputted to the ignition device 17 so that the ignition timing is controlled to the value, and drives the ignition plug 13.

Since the conventional control device of engine is composed as above, the correction of the fuel injection quantity at heavy load time is determined by the basic injection quantity and the engine speed, or by the intake air quantity and the engine speed. The correction is made by an open loop control. Therefore, the torque of the engine is not necessarily a maximum output torque.

Furthermore, the lowering of the output torque may be generated since the initially set air-fuel ratio and the ignition timing are deviated from the optimam values by the variation and the timewise change of the air flow meter 9, or the fuel injection valve 6, or the engine itself.

In case of an engine having a plurality of cylinders, since output of which cylinder varies each other, the smoothness and silence in the rotation of the engine may be deteriorated.

SUMMARY OF THE INVENTION

It is an object of the present invention to provide a control apparatus of an internal combustion engine capable of always running the engine in an optimum air-fuel ratio and/ or an optimum ignition timing, in spite of the elevation or the timewise change of the part of the engine, or an environmental change, whereby the variation of the output torque, the lowering of fuel cost, and the promotion of the responsiveness are expected, and insufficiency of the output torque and the instability of the operation are removed.

According to the present invention, there is provided a control apparatus of an internal combustion engine which comprises: a pressure detecting means for detecting an inner cylinder pressure of each cylinder of a plurality of cylinders of the internal combustion engine; a crank angle detecting means for detecting a crank angle of the internal combustion engine; indicated mean effective pressure calculating means for calculating an indicated mean effective pressure of each cylinder from an output of the pressure detecting means and an output of the crank angle detecting means; load detecting means for detecting a load of the internal combustion engine; speed detecting means for detecting an engine speed of the internal combustion engine from an output of the crank angle detecting means; running condition determining means for determining a running condition of the internal combustion engine from an output of the load detecting means and an output of the engine speed detecting means; and averaging and controlling means for controlling at least one of an air-fuel ratio and an ignition timing independently for each cylinder, so that an average value of each indicated mean effective pressure of the plurality of cylinders is independently maximized, based on an output of the indicated mean effective pressure calculating means, under a predetermined running condition determined by the running condition determining means.

According to the present invention, there is provided a control apparatus of an internal combustion engine which comprises: a pressure detecting means for detecting an inner cylinder pressure of each cylinder of a plurality of cylinders of the internal combustion engine; a crank angle detecting means for detecting a crank angle of the internal combustion engine; indicated mean effective pressure calculating means for calculating and indicated mean effective pressure of each cylinder from an output of the pressure detecting means and an output from the crank angle detecting means; load detecting means for detecting a load of the internal combustion; engine speed detecting means for detecting an engine speed of the internal combustion engine from an output of the crank angle detecting means; running condition determining means for determining a running condition of the internal combustion engine from an output of the load detecting means and an output of the engine speed detecting means; and averaging and controlling means for controlling at least one of an air-fuel ratio and an ignition timing, so that an average value of the indicated mean effective pressure which is averaged among the plurality of cylinders, is maximized, based on an output of the indicated mean effective pressure calculating means, under a predetermined running condition determined by the running condition determining means.

According to the present invention, there is provided a control apparatus of an internal combustion engine which comprises: pressure detecting means for detecting an inner cylinder pressure for each cylinder of a plurality of cylinders of the internal combustion engine; crank angle detecting means for detecting a crank angle of the internal combustion engine; indicated mean effective pressure calculating means for calculating an indicated mean effective pressure of each cylinder from an output of the pressure detecting means and an output of the crank angle detecting means; load detecting means for detecting a load of the internal combustion engine; engine speed detecting means for detecting the internal combustion engine speed from an output of the crank angle detecting means running condition determining means for determining a running condition of the internal combustion engine from an output of the load detecting means and an output of the engine speed detecting means; and averaging and controlling means for controlling at least one of an air-fuel ratio and an ignition timing independently for each cylinder, so that an averaging value of each indicated mean effective pressure of the plurality of cylinders becomes a predetermined target value, based on an output of the indicated mean effective pressure calculating means, under a predetermined running condition determined by the running condition determining means.

According to the present invention, there is provided a control apparatus of an internal combustion engine which comprises: pressure detecting means for detecting an inner cylinder pressure for each cylinder of a plurality of cylinders of the internal combustion engine; crank angle detecting means for detecting a crank angle of the internal combustion engine; indicated mean effective pressure calculating means for calculating an indicated mean effective pressure of each cylinder from an output of the pressure detecting means and an output of the crank angle detecting means; load detecting means for detecting a load of the internal combustion engine; engine speed detecting means for detecting the internal combustion engine speed from an output of the crank angle detecting means; running condition determining means for determining a running condition of the internal combustion engine from an output of the load detecting means and an output of the engine speed detecting means; and averaging and controlling means for controlling at least one of an air-fuel ratio and an ignition timing, so that an average value of the indicated mean effective pressure is maximized, based on an output of the indicated mean effective pressure calculating means, under a predetermined running condition determined by the running condition determined means; said averaging and controlling means memorizing a control quantity and a value related to the control quantity as learning values, and controlling at least one of an air-fuel ratio and an ignition timing utilizing at least one of memorized values or the learning values of the control quantity and the value related to the control quantity of a predetermined air-fuel ratio and an ignition timing, when the running condition of the internal combustion engine is in a predetermined running condition domain, and when at least one of the air-fuel ratio and the ignition timing can not be controlled, so that the average value of the indicated mean effective pressure is maximized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 25 is a flow chart showing the calculation treatment procedure in which the averaged value of the indicated mean the effective pressure is maximized, for the explanation of the third embodiment;

FIG. 26 is an explanatory diagram showing a two-dimensional map of a target value in the third embodiment;

FIG. 27 is an explanatory diagram showing a two-dimensional map of the air-fuel ratio correction coefficient;

DETAILED DESCRIPTION OF THE PREFERRED EMBODIMENTS

Figure 1:
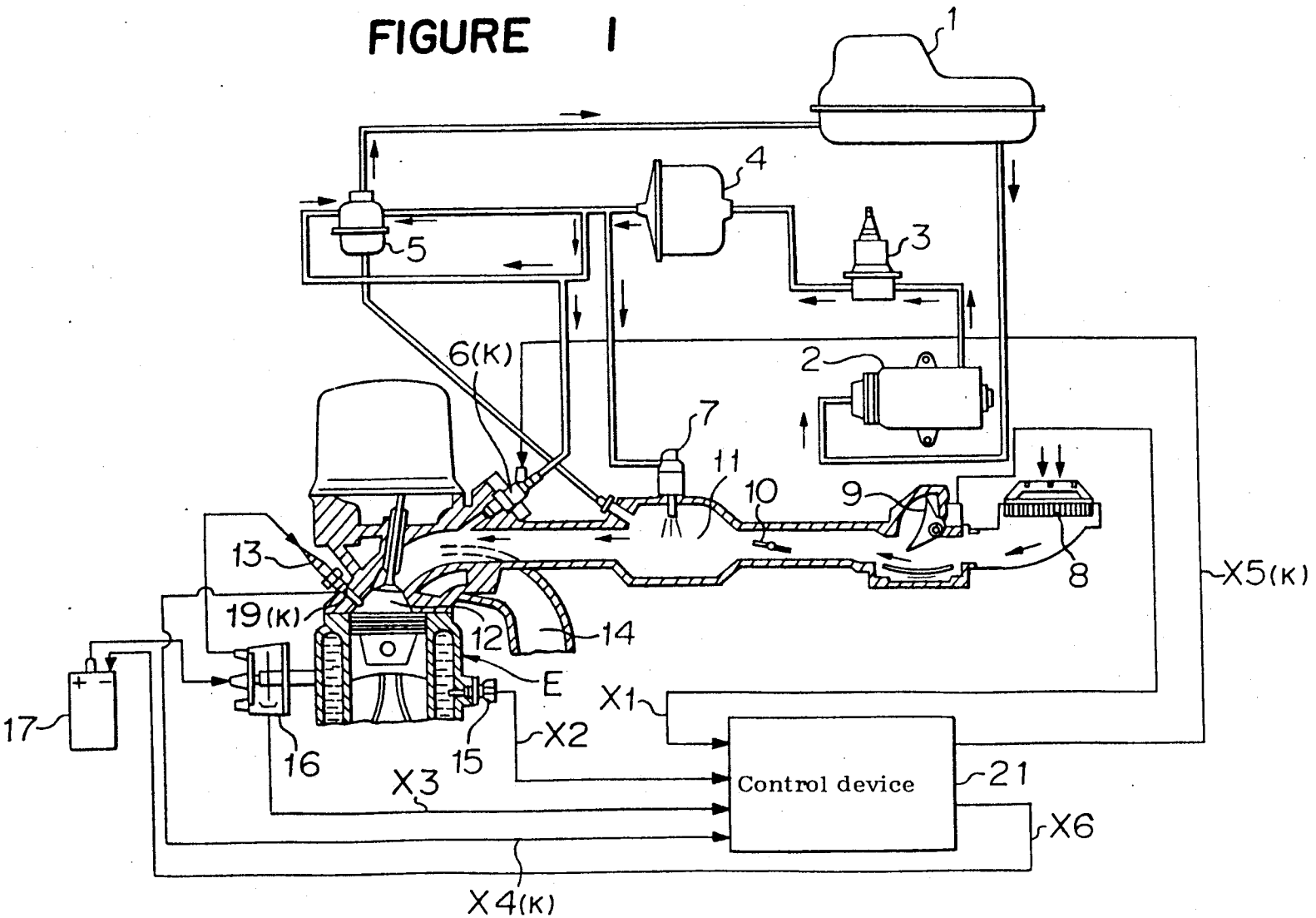
FIG. 1 is a construction diagram showing an embodiment of the control apparatus of the engine according to the present invention.

Referring to the drawings, explanation will be given to embodiments of the present invention.

FIG. 1 is an explanatory construction diagram showing an embodiment of the invention. In FIG. 1 the same notation is given to the same or the corresponding parts in FIG. 30, and the explanation is omitted. Explanation will be given to the parts different from FIG. 30.

Figure 30:
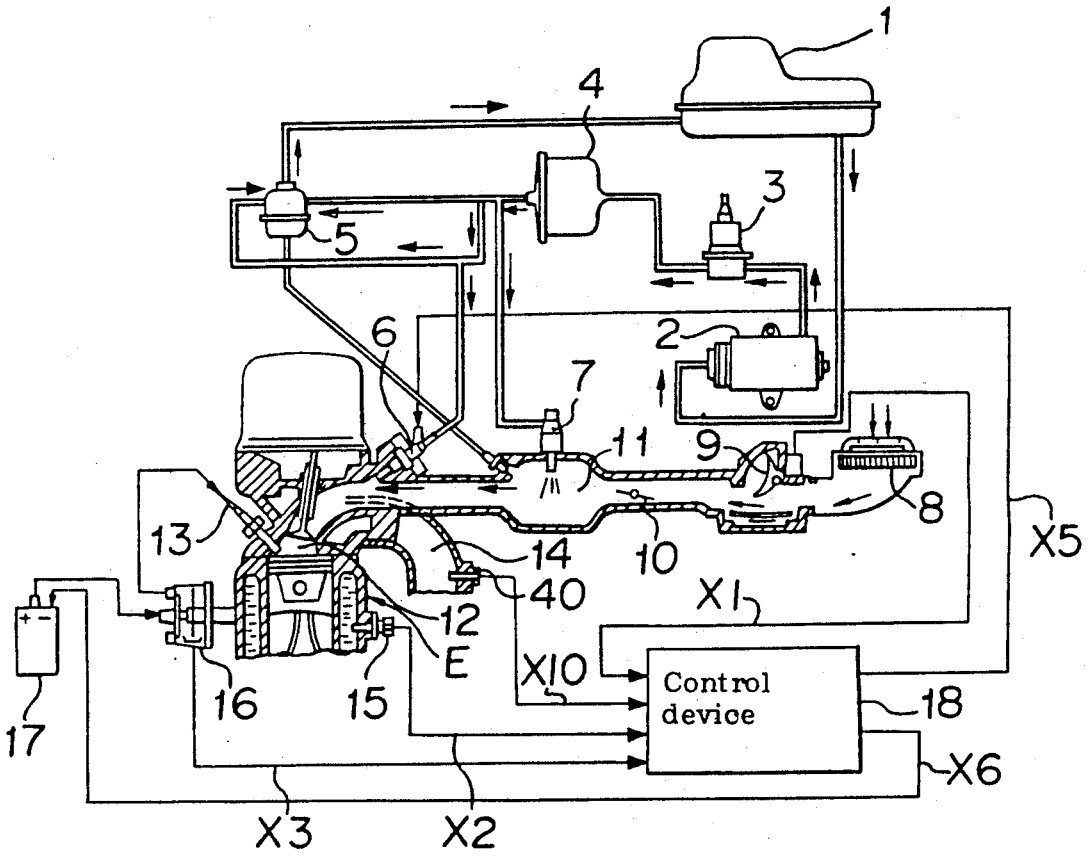
FIGURE 30 PRIOR ART
FIG. 30 is a construction diagram showing the conventional control device of the engine.

By comparing FIG. 1 with FIG. 30, numerals 1 to 17 in FIG. 1 are the same in FIG. 30, and the explanation is omitted. In this embodiment, explanation will be given to for instance a four cylinder engine E (hereinafter, this notation is omitted).

In the following explanation, $_{(k)}$ signifies No. k cylinder of the engine (k is a an integer; 1 to 4 in case that the engine has four cylinders), and when $_{(k)}$ is utilized as a suffix, the suffix is for No. k cylinder.

Figure 2A:
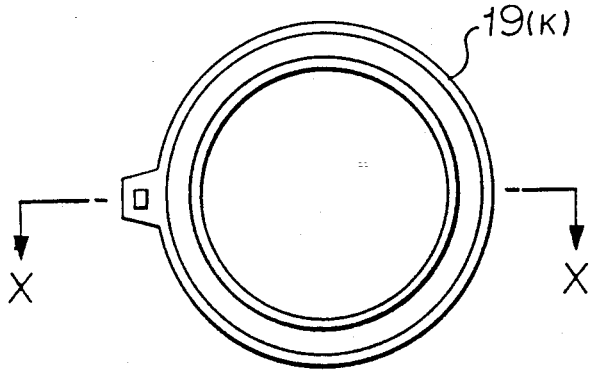
FIG. 2A is an elevation showing a pressure sensor utilized in the above embodiment.
Figure 2B:
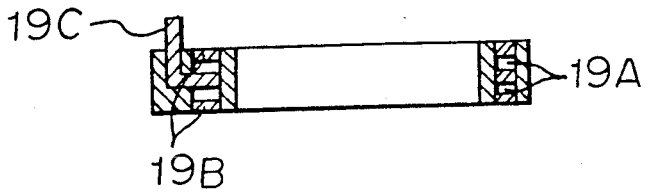
FIG. 2B is a sectional diagram showing the pressure sensor in FIG. 2A viewed along with line X—X.

19$_{(k)}$ signifies a pressure sensor for No. k cylinder which detects an inner cylinder pressure of No. k cylinder. This pressure sensor No. k is a piezoelectric element which is formed like a washer, as shown in FIGS. 2A (elevation), and 2B (sectional view taken along line X—X of FIG. 2A). The pressure sensor composed of the piezoelectric element 19A formed like a ring, the ring-like minus electrode 19B, and the plus electrode 19C.

Figure 3:
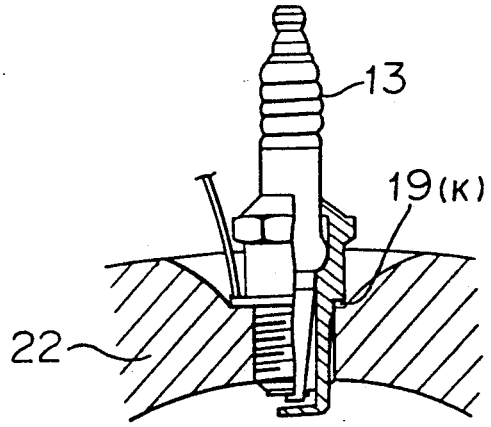
FIG. 3 is a partially cutaway diagram showing the mounting of the above pressure sensor on the cylinder head.

This pressure sensor 19$_{(k)}$ is mounted on the cylinder head 22, as shown in FIG. 3. FIG. 3 shows a part of the cylinder head in sectional view. The pressure sensor 19$_{(k)}$ is fixed to the cylinder head 22, clamped by the ignition plug 13 instead of a washer, and takes out the change of the pressure in the cylinder 12, as an electric signal. The above pressure sensor 19$_{(k)}$ and the fuel injection valve 6$_{(k)}$ are shown as parts of one cylinder, however, they are attached to the respective cylinders.

Furthermore, a numeral 21 signifies a new control device as a substitute to the control device 18 of FIG. 30, which is composed of a microcomputer.

The control device 21 receives an intake air quantity signal Xl from the air-flow meter 9, a water temperature signal X2 from the water temperature sensor 15, a crank angle signal X3 from the crank angle sensor 16, a pressure signal X4$_{(k)}$ from the pressure sensor 19$_{(k)}$, and so on, performs a predetermined calculation, and outputs an injection signal X5$_{(k)}$ and an ignition signal X6, by which the fuel injection valve 6$_{(k)}$ and the ignition device 17 are controlled.

Figure 4:
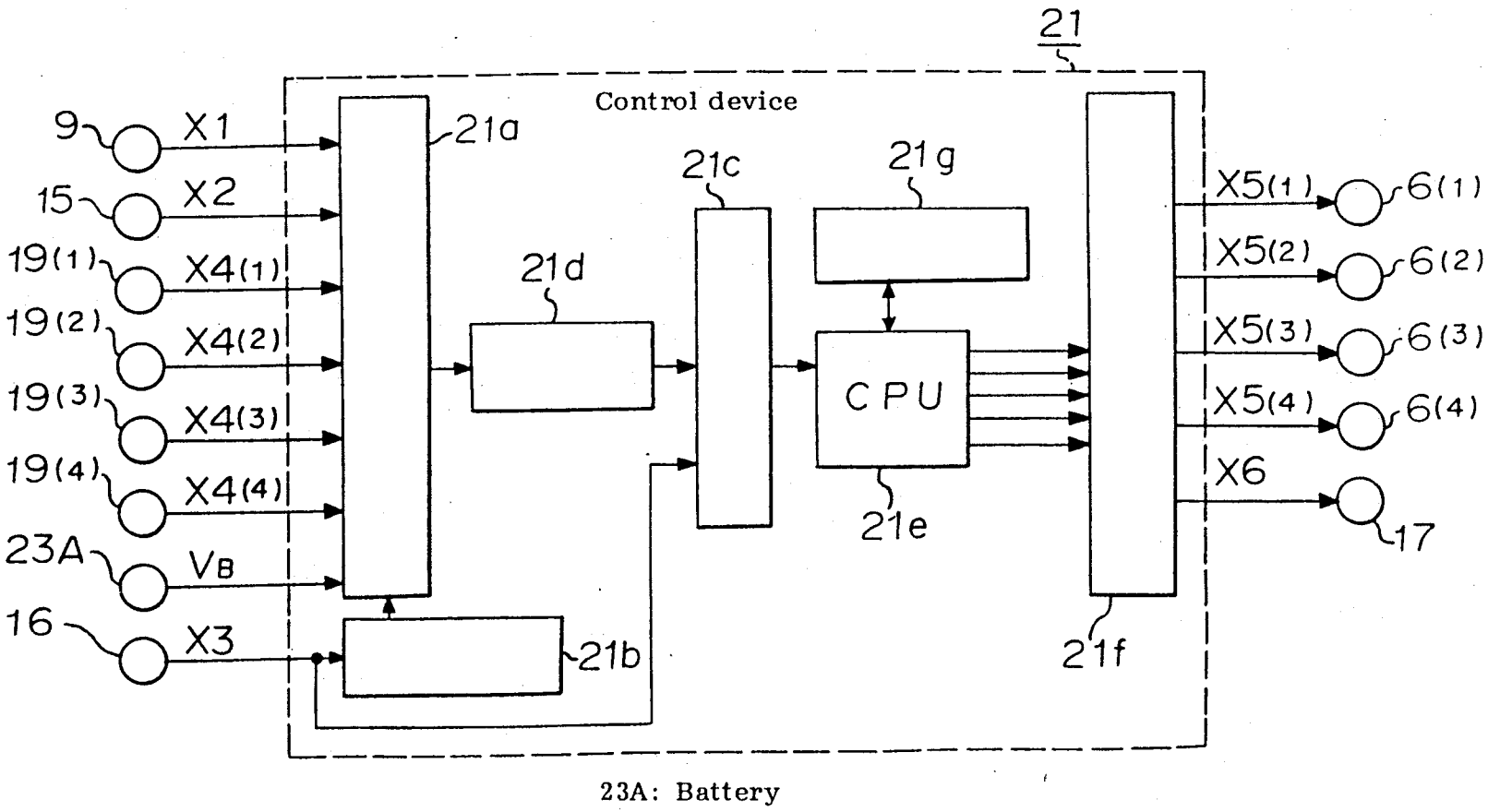
FIG. 4 is a block diagram showing an internal structure in the control device in the above embodiment.

FIG. 4 is a block diagram showing the internal structure of the control device 21. In FIG. 4, the intake air quantity signal Xl from the air-flow meter 9, the water temperature signal X2 from the water temperature sensor 15, the pressure signals X4$_{(1)}$ to X4$_{(4)}$ from the pressure sensors 19$_{(1)}$ to 19$_{(4)}$, and a voltage signal $V_B$ from the battery 23A are inputted to the multiplexer 21A of the control device 21.

Furthermore, the crank angle signal X3 from the crank angle sensor 16 is inputted to the latch circuit **21*b* and the input circuit 21*c***.

By the input of the crank angle signal X3 to the latch circuit **21*b*, the latch circuit 21*b* outputs to the multiplexer 21A. By this output, the multiplexer 21A switches the inputs of the intake air quantity signal X1, water temperature signal X2, each of the pressure signals $X4_{(1)}$ to $X4_{(4)}$, and the voltage signal $V_B$, and outputs each input signal selectively to the A/D (analogue/digital) convertor 21***d*.

The respective signals converted to digital signals by the A/D converter 21*d* and the crank angle signal X3 are sent to the CPU (central processing unit) 21*e* through the input circuit 21*c*, and are treated by calculation as shown in flow charts and so on, mentioned later. The calculated fuel injection signal $X5_{(k)}$ (which corresponds with an air-fuel ratio control signal, mentioned later) is amplified with respect to its electric power by the output circuit 21*f*, and sent to the fuel injection valve $6_{(k)}$ of the corresponding cylinder.

Furthermore, the ignition timing control signal which is calculated by the CPU 21*e*, is converted to the ignition signal X6 by the output circuit 21*f*, and sent to the ignition device 17.

A numeral 21*g* signifies a memory, which is composed of a RAM (random access memory) which temporarily memorize the data in the midst of the calculation in the CPU 21*e* and so on, and a ROM (read only memory) which memorizes beforehand calculation procedures or various data.

Figure 5:
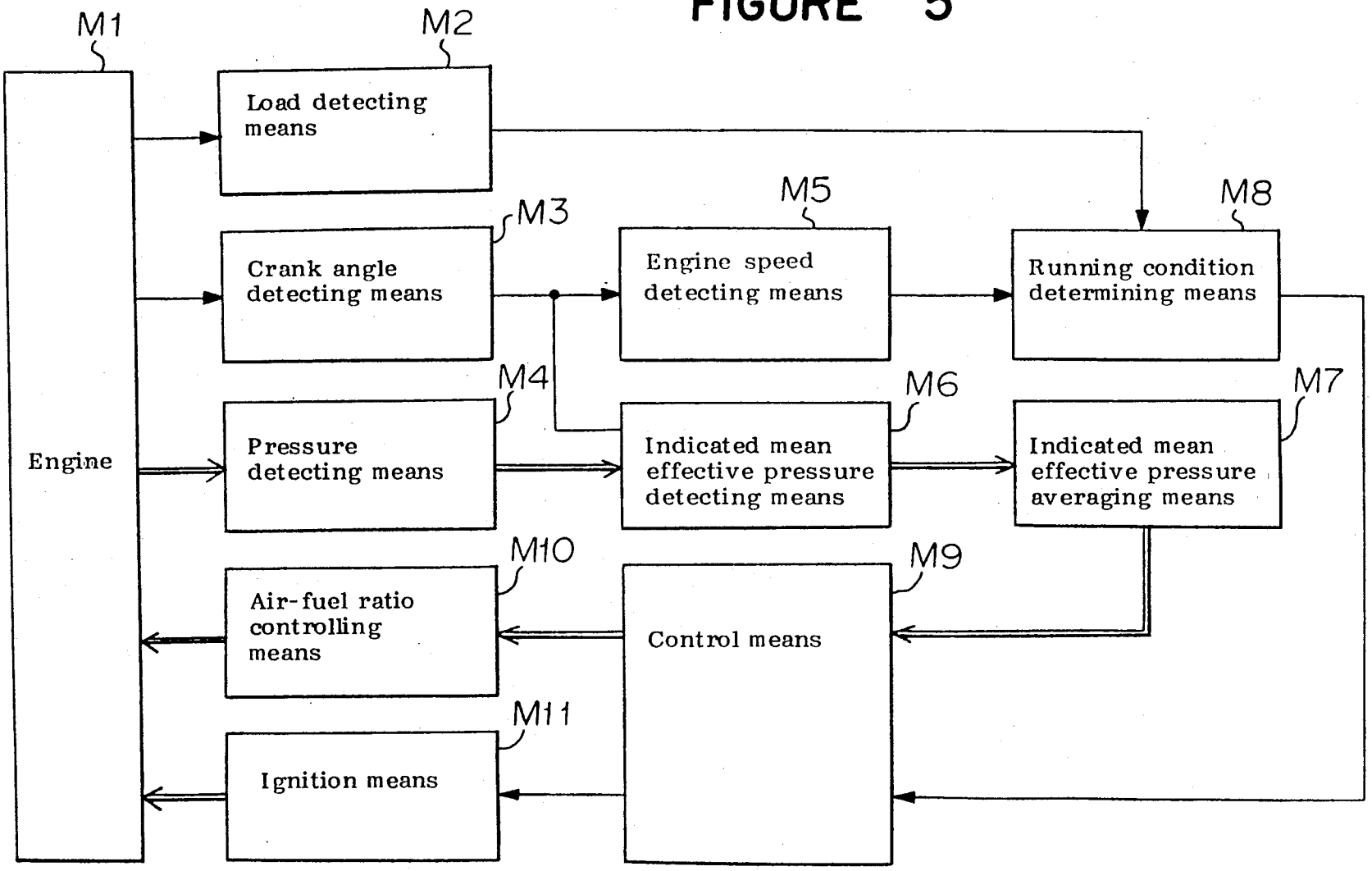
FIG. 5 is a block diagram which contains the element and the function of important parts in the above embodiment.

FIG. 5 is a block diagram showing functions of important parts of this invention. In FIG. 5, M1 is an engine which is an object of the control, and which corresponds with the engine E in FIG. 1. M2 is a load detecting means for detecting a load of the engine Ml.

This load detecting means M2 is for instance, the air-flow meter 9 shown in FIG. 1, or a manifold absolute pressure sensor which detects pressure in an intake manifold on the downstream side of the throttle valve 10, or a throttle valve opening degree sensor which detects the opening of the throttle valve 10.

M3 is a crank angle detecting means which detects a crank angle, for instance, corresponding to the crank angle sensor 16 in FIG. 1.

M4 is a pressure detecting means, which detects a pressure inside of the cylinder 12 with respect to each cylinder, for instance, corresponding with the pressure sensors $19_{(1)}$ to $19_{(4)}$ and so on.

M5 is an engine speed detecting means, which detects the engine speed Ml from time required for between the predetermined crank angles, by the output signal of the crank angle detecting means M3.

M6 is an indicated mean effective pressure calculating means. Assuming that an inner cylinder pressure cylinder of No. k cylinder for each crank angle is $P_{n(k)}$, the change of the stroke volume of No. k cylinder for each change of a predetermined angle (for instance 2° CA) of crank angle, is $\Delta V_{(k)}$, and the stroke volume of No. k cylinder is $V_{(k)}$, which are obtained from the output of the respective crank angle detecting means M3 and the output of the pressure detecting means M4, the indicated mean effective pressure of No. k cylinder Pi(k) is obtained by $P_{i(k)}=\Sigma(P_{n(k)}\times\Delta V_{(k)})\ /\ V_{(k)}$ with respect to each cylinder.

In this equation, since $V_{(k)}$ is constant, the above equation is approximated to the equation, $P_{i(k)}=P_{i(k)}+\Delta V_{(k)}\cdot P_{n(k)}$.

M7 is an indicated mean effective pressure averaging means which performs a calculation of an arithmetic means of a predetermined numbers of the outputs from the indicated mean effective pressure detecting means for respective cylinders, and obtains average values of the indicated mean effective pressure for respective cylinders.

The running condition determining means determines whether the running condition of the present engine M1 satisfies the predetermined steady state running condition, from an output of the load detecting means M2 and an output of the engine speed detecting means M5.

The control means M9 determines that the engine M1 is in a predetermined running condition, from on output of the running condition determining means M8 and an output of the indicated means effective pressure averaging means M7, determines at least one of the air-fuel ratio and the ignition timing independently for each cylinder so that the average value of the indicated mean effective pressure for each cylinder is independently maximized, and outputs them.

M10 is an air-fuel ratio controlling means, which controls the mixture, for each cylinder, to be supplied to the engine M1 corresponding to the air-fuel ratio control signal which is given by the above control means M9.

This air-fuel ratio controlling means M10 can utilize the fuel injection valve $6_{(1)}$ to $6_{(4)}$ in FIG. 1, or a carburetor which can adjust the air-fuel ratio by an electric signal (for instance, Japanese Unexamined Patent Publication No. 132326/1976).

Moreover, M11 is an ignition means, which ignites the mixture at an ignition timing corresponding to an ignition timing control signal which is given by the control means M9, and, for instance, can utilize a full-transistor-type ignition device (which is consisted of a power transistor switching circuit and an ignition coil), and the ignition plug 13.

The above engine speed detecting means M5, the indicated mean effective pressure detecting means M6, the running condition determining means M8, the indicated mean effective pressure averaging means M7, and the control means M9, are incorporated in the control device 21 in FIG. 1. The indicated mean effective pressure averaging means M7 and the control means M9 compose an averaging and control means. The above running condition determining means M8 is connected to the control means M9 through the indicated mean effective pressure averaging means M7.

Figure 6:
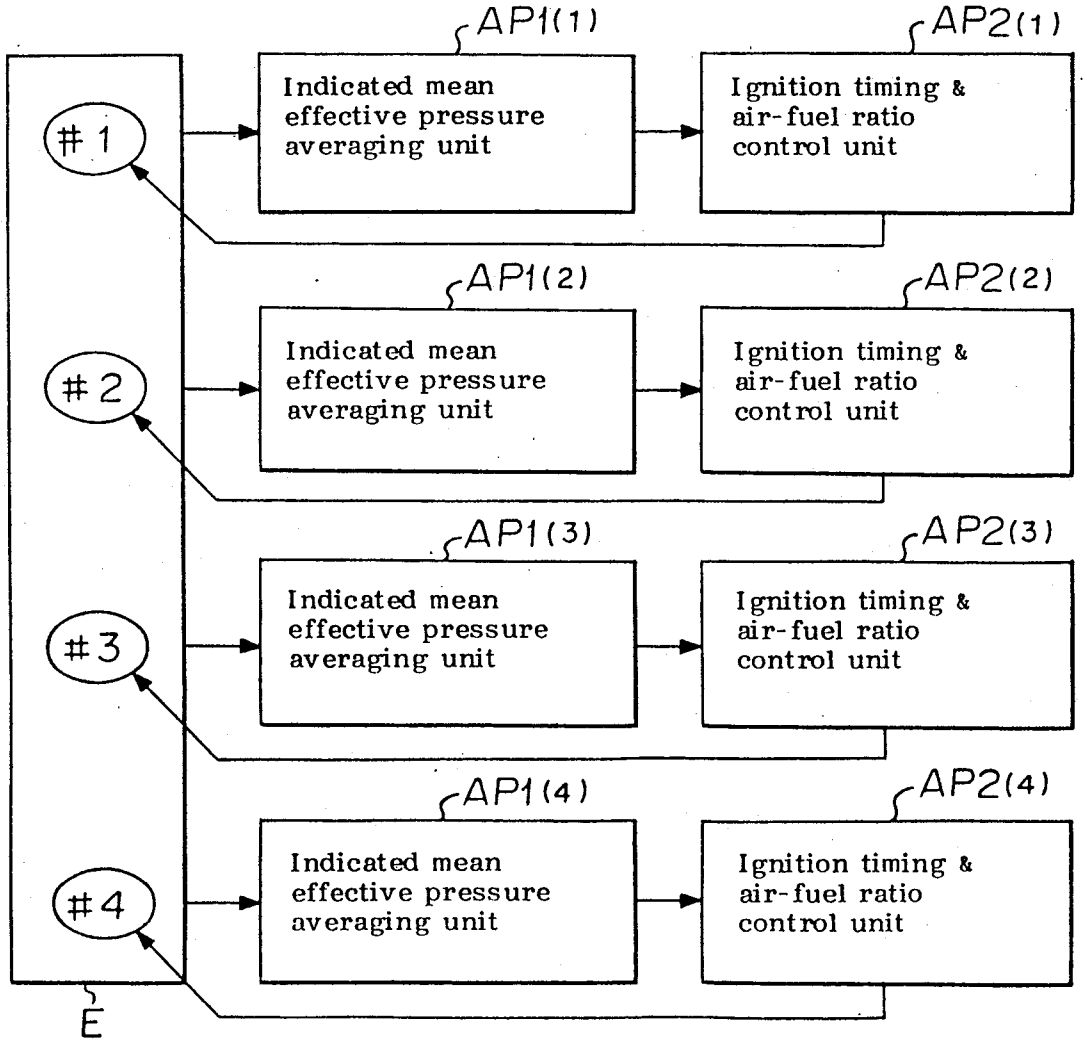
FIG. 6 is an outline diagram showing the outline structure of the device of the above embodiment.

FIG. 6 shows in general the important parts of an embodiment of the present invention. The engine is composed of the first cylinder #1 to fourth cylinder #4. For each cylinder of the group of the first cylinder #1 to the fourth cylinder #4, an indicated mean effective pressure averaging unit $AP1_{(k)}$ for averaging the indicated mean effective pressure $P_{i(k)}$, is installed. Each ignition timing and air-fuel ratio control unit $AP2_{(k)}$ is connected to each indicated mean effective pressure averaging unit $AP1_{(k)}$. At least one of the ignition timing and the air-fuel ratio (the air-fuel ratio in this embodiment) is controlled independently for each cylinder of the engine in $AP2_{(k)}$, to maximize the average value of the indicated mean effective pressure outputted from the indicated mean effective averaging unit $AP1_{(k)}$.

Next, to facilitate understanding of an embodiment of the present invention, explanation will be given to a principle in which the average value of the indicated mean effective pressure is maximize by the air-fuel ratio control or by the ignition timing control.

Figure 7:
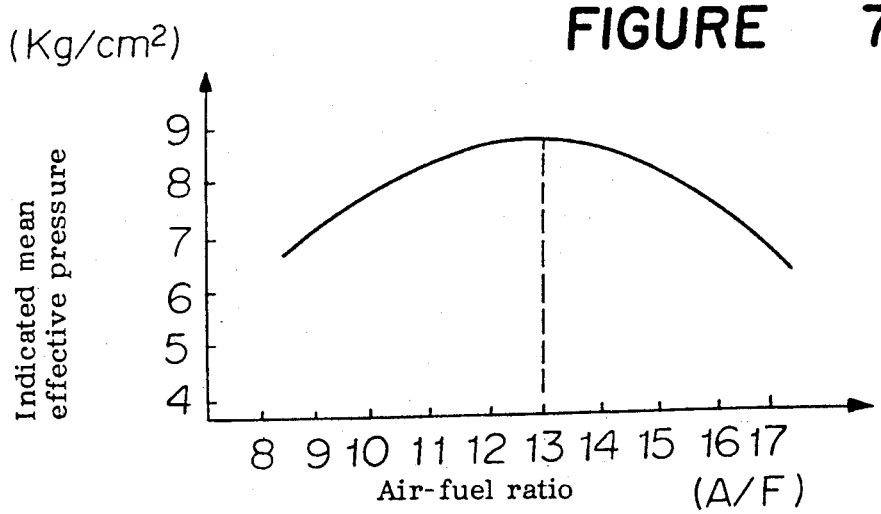
FIG. 7 is a characteristic diagram showing the relationship between the air-fuel ratio and the averaged indicated mean effective pressure for the explanation of the embodiment.

FIG. 7 is a characteristic diagram showing the relationship between the air-fuel ratio and the average value of the indicated mean effective pressure. The values in the diagram are taken and the condition of a constant engine speed, (for instance, 2000 rpm) and under the condition in which a throttle valve is fully open.

As shown in FIG. 7, the average value of the indicated mean effective pressure of the engine is maximized in the neighborhood of the air-fuel ratio of 13. Accordingly, by changing the set air-fuel ratio, by measuring the indicated mean effective pressure corresponding to the set air-fuel ratio, by obtaining the average value, and by determining the air-fuel ratio so that the average value of the above indicated mean effective pressure is maximized, the air-fuel ratio at heavy load time can be controlled to an optimum air-fuel ratio (LBT).

Figure 8:
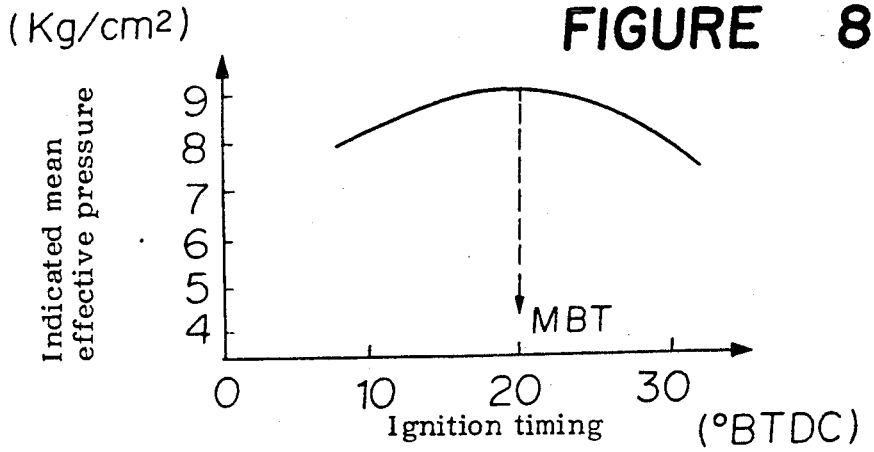
FIG. 8 is a characteristic diagram showing the relationship between the ignition timing and the averaged indicated mean effective pressure for the explanation of the above embodiment.

FIG. 8 shows the relationship between the ignition timing and the average value of the indicated mean effective pressure. As shown in FIG. 8, similar to the case in which the average value of the indicated mean effective pressure is maximized by changing the air-fuel ratio, by changing the set ignition advance angle, and by determining the ignition advance angle, so that the average value of the indicated mean effective pressure corresponding to the set ignition advance angle is maximized, the ignition timing may always be set to MBT point.

In this way, the average value of the indicated mean effective pressure can be maximized by the air-fuel ratio control or by the ignition timing control.

Figure 9:
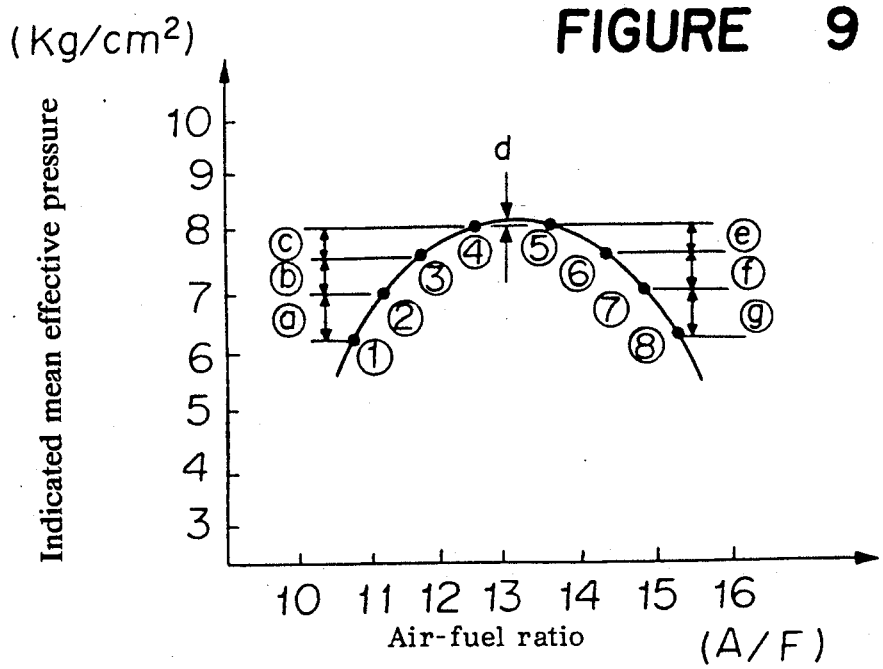
FIG. 9 is an explanatory diagram showing a control operation based on the relationship between the air-fuel ratio and the averaged indicated mean in effective pressure for the explanation of the above embodiment.

Next, explanation will be given to a principle of the setting the air-fuel ratio in which the average value of the indicated mean effective pressure is maximized for the respective cylinders, in case that No. k cylinder of the engine has a characteristic between the air-fuel ratio and the average value of the indicated mean effective pressure as shown in FIG. 9.

First of all, explanation will be given to the measured indicated mean effective pressure. Since each combustion in the engine causes a change with cycle, the measured indicated mean effective pressure varies even with the same air-fuel ratio.

Accordingly, judgment should be made by the indicated mean effective pressure which is averaged for several cycles, that is, the average value of the indicated mean effective pressure.

However, in the practical point of view, even the averaged indicated mean effective pressure has a variation. The indicated mean effective pressure $P_{(i)k}$ is measured corresponding to the set air-fuel ratio, should be regarded as being in a certain degree of variation width.

Next, in order to the detect that the average value of the indicated mean effective pressure has a maximum value at the set air-fuel ratio, having a relationship of the average value of the indicated mean effective pressure as shown in FIG. 9, the increase or the decrease of the average value of the indicated mean effective pressure $P_{(i)k}$, $\Delta P_{(i)k}$ is investigated, by changing the air-fuel ratio.

In order to determine that the average value of the mean effective pressure has a maximum value at the set fuel ratio, the result of the change of increase or decrease of the indicated mean effective pressure difference $\Delta P_{(i)k}$, which is a difference between the average values of the indicated mean effective pressures of No. k cylinder, is investigated by changing the set air-fuel ratio.

Next, explanation will be given to the procedure of determining that the average value of the indicated mean effective pressure is maximized.

Referring to FIG. 9, when the set air-fuel ratio is changed, as ① to ⑧ (which represent set air-fuel ratios), the absolute value of the indicated mean effective pressure difference $|\Delta P_{i(k)}|$ is obtained as ⓐ to ⓖ (which represent the absolute values of the indicated mean effective pressure difference).

ⓐ is the absolute value of the indicated mean effective pressure difference $|\Delta P_{i(k)}|$ when the air-fuel ratio is changed from ① to ②, and the similar definition is given to the absolute values of the indicated mean effective pressure differences ⓑ to ⓖ.

As mentioned above, the average value of the indicated mean effective pressure $P_{i(k)}$ varies. Therefore, the width of variation in which $P_{i(k)}$ is judged as not to increase nor to decrease, that is, the dead zone threshold value $|\Delta P_{iP}|$ for determining a dead zone, is utilized.

Accordingly, when $|\Delta P_{i(k)}| \leqq |\Delta P_{iP}|$, the indicated mean effective pressure difference $\Delta P_i$ is judged as not increasing nor decreasing. By using the dead zone threshold value $|\Delta P_{ip}|$, for instance, the following relationship is established.

$$ⓐ, ⓖ > |\Delta P_{ip}| > ⓑ\ ⓒ\ ⓓ\ ⓔ\ ⓕ \quad (2)$$

This relationship, as shown in FIG. 9, means that the maximum of the average value of the indicated mean effective pressure exists between the set air-fuel ratios ② and ⑦.

In this case, it is natural to think that the air-fuel ratio which maximizes the average value of the indicated mean effective pressure is at the center between the air-fuel ratios ② and ⑦. By thinking in this way, the procedure for determining the air-fuel ratio which is at the center of between the set air-fuel ratios ② and ⑦, is as follows.

The set air-fuel ratio is changed by the increments of $\Delta A/F$ from ①. When the absolute value of the indicated mean effective pressure difference $|\Delta P_{i(k)}|$ is smaller than $|\Delta P_{ip}|$ (for instance, which corresponds to the state of the set air-fuel ratio ② in FIG. 9), counting begins one by one of $\Delta A/F$, and the counting continues, until the absolute value of the indicated mean effective pressure difference $|\Delta P_{i(k)}|$ becomes larger than the dead zone threshold value $|\Delta P_{ip}|$ again. The counted number is C.

In this explanation, $\Delta A/F$ is a set air-fuel ratio change quantity.

Since the count is made in the above way, the air-fuel ratio which is situated at the center of between set air-fuel ratios of ② and ⑦, becomes a value of the set air-fuel ratio ⑧ subtracted by $(C/2 \times \Delta A/F)$.

This subtraction of the air-fuel ratio is performed as follows. When the direction of change of the air-fuel ratio in the range from the set air-fuel ratio ① to the set air-fuel ratio ⑧ is in the direction of "rich", that is, in the direction of increasing fuel quantity, the subtraction of the air-fuel ratio should be made in the direction of "lean", that is , in the direction of decreasing fuel quantity.

When the change of the direction of the air-fuel ratio in the range from set air-fuel ratio ① to the set air-fuel ratio ⑧, is in the direction of "lean", that is, in the direction of decreasing fuel quantity, the subtraction of the air-fuel ratio should be made in the direction of "rich", that is, in the direction of increasing fuel quantity.

In this way, by changing the air-fuel ratio, the air-fuel ratio in which the average value of the indicated mean effective pressure is maximized, is determined.

When the average value of the indicated mean effective pressure corresponding to the ignition timing has a characteristic shown in FIG. 8, the method of the determining the ignition timing for maximizing the average value of the indicated mean effective pressure is the same with that in the case of the above the air-fuel ratio.

Accordingly, the air-fuel ratio which is changed for maximizing the average value of the indicated mean effective pressure, is replaced with the ignition timing.

As mentioned above, the air-fuel ratio or the ignition timing can be determined or set so that the average value of the the indicated mean effective pressure is maximized. By performing this operation with respect to each cylinder of all the cylinders independently, the optimum air-fuel ratio or the optimum ignition timing with respect to each cylinder can be determined.

Next, explanation will be given to the content of calculation of this embodiment.

First of all, the method of calculating of the indicated mean effective pressure will be mentioned.

The indicated mean effective pressure $P_{i(k)}$ is the value of the work of fuel gas exerted on a piston during one cycle (2 revolutions of engine), divided by the stroke volume. Assuming that the inner cylinder pressure at each crank angle outputted from the pressure sensor 19$_{(k)}$, is $P_{n(k)}$, the change of the stroke volume by the change of crank angle by unit angle (for instance, 2° CA) is $\Delta V_{(k)}$, $P_{i(k)}$ is approximately obtained by the following equation (3).

$$P_{i(k)}=P_{i(k)}+\Delta V_{(k)}\cdot P_{n(k)} \quad (3)$$

Accordingly, the inner cylinder pressure $P_{n(k)}$ in a current calculation, and the change of the stroke volume $\Delta V_{(k)}$ are multiplied. The multiplied result is added to the value of the indicated mean effective pressure $P_{i(k)}$ of preceding (for instance 2° CA of crank angle) calculation. The added value is the indicated mean effective pressure $P_{i(k)}$, according to the equation (3). The result of the calculation performed in one cycle (2 revolutions of engine, for instance, 4 strokes of No. k cylinder from the beginning of the suction stroke to the end of the exhaust stroke), becomes the indicated mean effective pressure $P_{i(k)}$ of No. k cylinder.

The reference position pulse generated at every 180° from the crank angle sensor 16 of FIG. 1 incorporates a cylinder identifying signal which identifies as No. 1 cylinder at every 720° CA. The control device 21, when it detects this cylinder identifying signal, finishes measuring of the indicated mean effective pressure of No. 1 cylinder of the engine, as well as starts measuring a new indicated mean effective pressure. In case of No. 3 cylinder, with a phase lag of 180° CA compared with the case of No. 1 cylinder, in case of No. 4 cylinder, with a phase lag of 360° CA, and in case of No. 2 cylinder with a phase lag of 540° CA, the measurement of the indicated mean effective pressure is performed for the respective reference positions. The control device 21 identifies cylinder at every input of the reference position pulse from the crank angle sensor 16, switches the measurement of the indicated mean effective pressure, and successively obtains the indicated mean effective pressure for respective cylinders of the engine. The order of No. 1 cylinder, No. 3 cylinder, No. 4 cylinder, and No. 2 cylinder is also the firing order of the engine.

The basic fuel injection quantity, as in the aforementioned conventional example, is determined by $T_p=K\times Q/N_e$.

Accordingly, the desired fuel injection quantity of No. k cylinder, $T_{i(k)}$, based on $T_p$, using air-fuel ratio oorrection coefficient of No. k cylinder, $C_{AF(k)}$, is determined by the following equation (4).

$$T_{i(k)}=T_p\times C_{AF(k)}\times(1+F_l+KMR/100)\times\beta+T_{s(k)} \quad (4)$$

In this equation, when the air-fuel ration is determined, by which the average value of the indicated mean effective pressure is maximized, as mentioned later, it is necessary to determine the values in which $F_l$ and KMR are 0, and $\beta$ is 1, and the like.

$T_{s(k)}$ is a correction coefficient depending battery voltage for, in principle, correcting the characteristic of the fuel injection valve 6$_{(k)}$ and does not effect on the set air-fuel ratio itself.

As a supplemental explanation, to make the air-fuel ratio "rich", that is, to increase the fuel injection quantity $T_{i(k)}$ of NO. k cylinder, the air-fuel ratio correction coefficient of No. k cylinder $C_{AF(k)}$ should be increased to a value which is equal to or more than 1.

To make the air-fuel ratio "lean", that is, to decrease the fuel injection quantity $T_{i(k)}$, the air-fuel ratio correction coefficient $C_{AF(k)}$ should be decreased to a value which is equal to or less than 1.

Next, explanation will be given to a logic to determine the air-fuel ratio by which the average value of the indicated mean effective pressure is maximized.

In this explanation, in the following description of each embodiment, when $_{(i)}$ is utilized as a suffix, it signifies the current treated value, and when $_{(i-1)}$ is utilized as a suffix, it signifies a preceding treated value.

First of all, explanation will be given to flag F1$_{(k)}$. As mentioned before, to make the indicated mean effective pressure a maximum value, by changing the air-fuel ratio, the process of changing the ignition timing should be grasped.

Therefore, a flag is utilized which shows how the preceding air-fuel ratio is set in each treatment of flow chart shown in FIG. 9, for respective cylinder. This flay is flag F1$_{(k)}$, which are grossly classified to the three states as in the following Table 1.

TABLE 1

| Flag Fl$_{(k)}$ | Treatment |
|---|---|
| S0 | Represents an initial state wherein the treatment of maximizing the indicated mean effective pressure, is not started. |
| S10 to S1A | Represents a state wherein the air-fuel ratio for maximizing the indicated mean effective pressure, is searched by changing the air-fuel ratio, as shown in Table 2. |
| S2 | Represents a state wherein setting of the air-fuel ratio is finished, by which the indicated mean effective pressure is maximized. |

As shown in Table 1, when flag F1$_{(k)}$ is S0, F1$_{(k)}$ shows an initial state in which a treatment for maximizing the indicated mean effective pressure is not started.

Explanation is given in details in Table 2, in case that flag F1$_{(k)}$ is S10 to S1A. In short, F1$_{(k)}$ shows a state in which the operation is determining the air-fuel ratio in which the indicated mean effective pressure has a maximum value by judging the increase or the decrease of the change of the indicated mean effective pressure $\Delta P_i$ after the air-fuel ratio is increased or decreased.

When flag F1$_{(k)}$ is set as S2, F1$_{(k)}$ shows, as described in Table 1, a state after the air-fuel ratio is set which maximizes the indicated mean effective pressure.

In this way, flag $F1_{(k)}$ shows every past history determining the air-fuel ratio.

Next, explanation will be given to the state in which the air-fuel ratio that maximizes the indicated mean effective pressure, is being determined, which is classified by in Table 2.

TABLE 2

| Flag Fl(k) | Treatment |
|---|---|
| S10 | GO TO S11, ΔA/F = RICH. |
| S11 | if $\lvert\Delta p_i\rvert \leqq \lvert\Delta p_{ip}\rvert$, S11 STAY, ΔA/F = RICH.<br>if $\Delta P_i$ INC, GO TO S13, ΔA/F = RICH.<br>if $\Delta P_i$ DEC, GO TO S12, ΔA/F = LEAN. |
| S12 | if $\lvert\Delta p_i\rvert \leqq \lvert\Delta p_{ip}\rvert$, GO TO S14, ΔA/F = LEAN, START COUNTING NO. OF LEAN.<br>if $\Delta P_i$ INC, GO TO S15, ΔA/F = LEAN.<br>if $\Delta P_i$ DEC, GO TO S16, ΔA/F = RICH.<br>(vibrating around $P_i$ peak) |
| S13 | if $\lvert\Delta p_i\rvert \leqq \lvert\Delta p_{ip}\rvert$, GO TO S17, ΔA/F = RICH, START COUNTING NO. OF RICH.<br>if $\Delta P_i$ INC, S13 STAY, ΔA/F = RICH.<br>if $\Delta P_i$ DEC, GO TO S18, ΔA/F = LEAN.<br>(vibrating around $P_i$ peak) |
| S14 | if $\lvert\Delta p_i\rvert \leqq \lvert\Delta p_{ip}\rvert$, S14 STAY, ΔA/F = LEAN, START COUNTING NO. OF LEAN.<br>if $\Delta P_i$ INC, GO TO S15, ΔA/F = LEAN.<br>if $\Delta P_i$ DEC, GO TO S19, A/F IS RICHED BY ((NO. OF LEAN + 1)/2) × ΔA/F. |
| S15 | if $\lvert\Delta p_i\rvert \leqq \lvert\Delta p_{ip}\rvert$, GO TO S14, ΔA/F = LEAN, START COUNTING NO. OF LEAN.<br>if $\Delta P_i$ INC, S15 STAYS, ΔA/F = LEAN.<br>if $\Delta P_i$ DEC, GO TO S16, ΔA/F = RICH.<br>(vibrating around $P_i$ peak) |
| S16 | if $\lvert\Delta p_i\rvert \leqq \lvert\Delta p_{ip}\rvert$, GO TO S19, ΔA/F STAY.<br>if $\Delta P_i$ INC, GO TO S13, ΔA/F = RICH.<br>if $\Delta P_i$ DEC, GO TO S18, ΔA/F IS LEANED BY PRECEDING ΔA/F × ½, however if the ΔA/F IS SMALLER THAN $\Delta A/F_{min}$, GO TO S19. |
| S17 | if $\lvert\Delta p_i\rvert \leqq \lvert\Delta p_{ip}\rvert$, S17 STAY, ΔA/F = RICH, START COUNTING NO. OF RICH.<br>if $\Delta P_i$ INC, GO TO S13, ΔA/F = RICH.<br>if $\Delta P_i$ DEC, GO TO S19, ΔA/F IS LEANED BY (NO. OF RICH + 1)/2) × ΔA/F. |
| S18 | if $\lvert\Delta p_i\rvert \leqq \lvert\Delta p_{ip}\rvert$, GO TO S19, ΔA/F STAY.<br>if $\Delta P_i$ INC, GO TO S15, ΔA/F = LEAN.<br>if $\Delta P_i$ DEC, GO TO S16, F/A IS RICHED BY PRECEDING ΔA/F × ½, however if the ΔA/F IS SMALLER THAN $\Delta A/F_{min}$, GO TO S19. |
| S19 | MEMORIZE $P_i$ VALUE, GO TO S1A, ΔA/F STAY. |
| S1A | if $\lvert\Delta p_i\rvert \leqq \lvert\Delta p_{ip}\rvert$, GO TO S2, ΔA/F STAY.<br>if $\Delta P_i$ INC OR $\Delta P_i$ DEC, GO TO S0, ΔA/F STAY. |

In Table 2, $\Delta P_i$ INC means that $\Delta P_i > \lvert\Delta P_{ip}\rvert$, and $\Delta P_i$ DEC means that $\lvert\Delta P_i\rvert > \lvert\Delta P_{ip}\rvert$, and $\Delta P_i < 0$. ΔA/F = LEAN means that $C_{AF(k)(i)} = C_{AF(k)(i-l)} - \Delta A/F$, and ΔA/F = RICH means that $C_{AF(k)(i)} = C_{AF(k)(i-l)} + \Delta A/F$.

In Table 2, the value of flag $F1_{(k)}$ is set, corresponding to the case in which the characteristic of the air-fuel ratio and the indicated mean effective pressure is as shown in FIG. 9, by judging of the direction of change of the air-fuel ratio, and the increase or the decrease of the indicated mean effective pressure change $\Delta P_{i(k)}$ by the change, so that the process of the determination is explained.

Explanation will be give tot he cases for respective values of flag $F1_{(k)}$ shown in Table 2. Hereinafter, flag S10 to flag S1A are simply described as S10 to S1A. The criteria is as mentioned before, based on the case of FIG. 9. First of all, in what state the means effective pressure $P_{i(k)}$ is, with respect to the air ratio in which the correction coefficient of the fuel injection (air-fuel ratio correction coefficient), of No. k cylinder in equation (4), $C_{AF(k)}$ (hereinafter simply described as $C_{AF(k)}$) is 1, is not determined.

Explaining by FIG. 9, it is not decided whether the set air-fuel ratio is the set air-fuel ratio (8). Therefore, the indicated mean effective pressure $P_{i(k)(i)}$ is measured which is a standard of the state for flag F1(K)=S0, (which is a state in which the set air-fuel ratio and the indicated mean effective pressure are not decided).

This is the state Of $F1_{(k)}$=S10. $C_{AF(k)}$ is corrected to "rich" side by a predetermined air-fuel ratio change quantity ΔA/F (hereinafter simply described as ΔA/F).

Accordingly, $C_{AF(k)(i)} = C_{AF(k)(i-l)} + \Delta A/F$ (which is shown in Table 2 as ΔA/F =RICH, that shows the above operation).

$C_{AF(k)}$ is corrected to "lean" by a predetermined air-fuel ratio change quantity ΔA/F. This Operation is $C_{AF(k)(i)} = C_{AF(k)(i-l)} - \Delta A/F$. (which is shown in Table 2; as ΔA/F =LEAN.)

Figure 10:
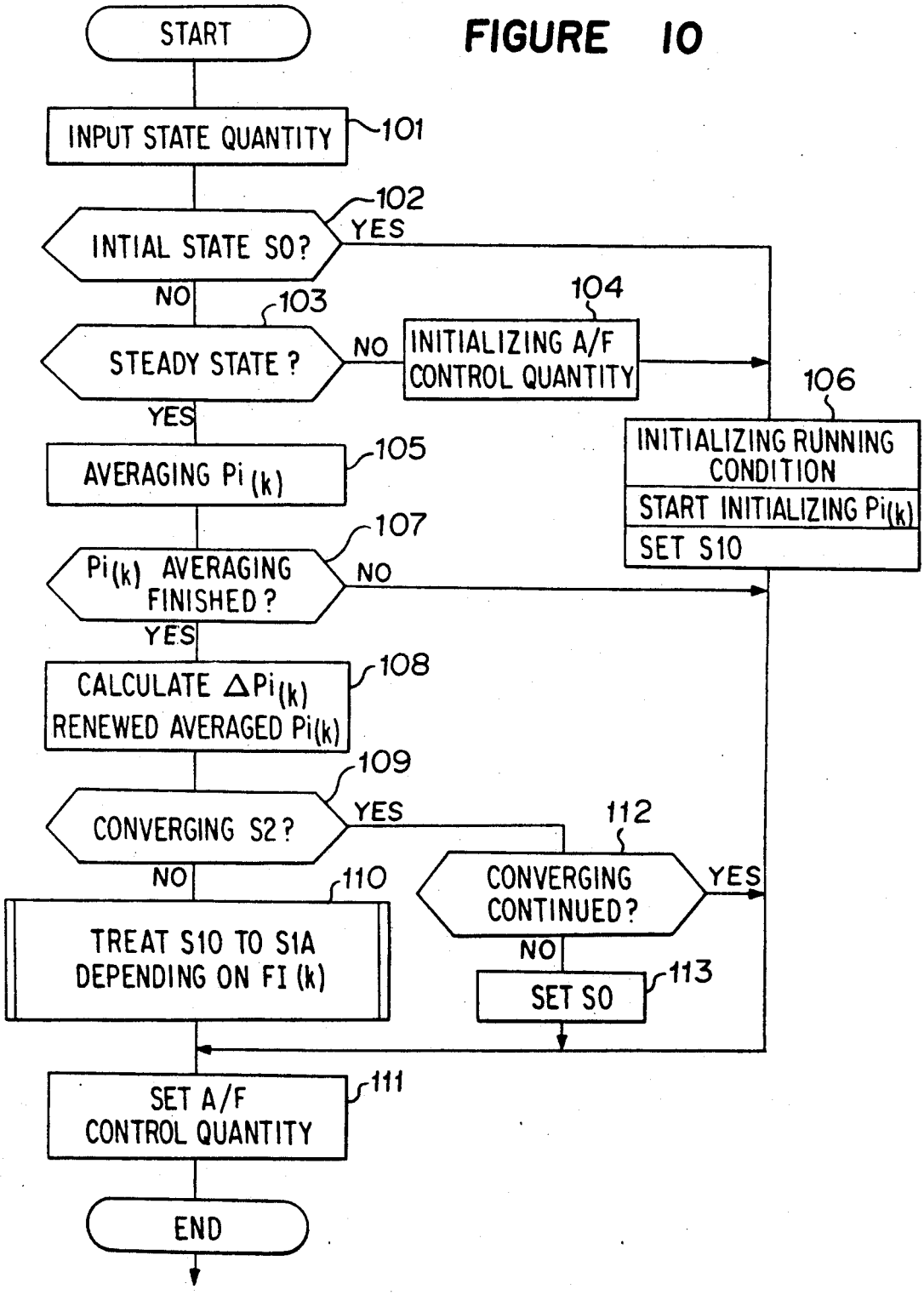
FIG. 10 is a flow chart showing a calculation treatment procedure in which the averaged value of the indicated mean in effective pressure is maximized, for the explanation of the above embodiment.

The above Tables 1 and 2 explain on flag $F1_{(k)}$ which is utilized for obtaining the air-fuel ratio by which the average value of the indicated mean effective pressure $P_{i(k)}$ of No. K cylinder is maximized. Next, after the flow chart of FIG. 10 is explained, explanation will be given in details referring to the flow chart of FIG. 11 to 21.

Explanation will be given to a logic obtaining the air-fuel ratio which maximizes by average value of the indicated mean effective pressure $P_{i(k)}$, following the flow chart in FIG. 10. In the treatment of the flow chart in FIG. 10, as mentioned before, by the interruption treatment of the program generated at every predetermined crank angle, for instance at every 180° CA, calculation is made for respective cylinder during 720° CA, and after the average value of the indicated mean effective pressure for the respective cylinder is renewed, the operation is performed by the control device 21. Accordingly, the operation performs the cylinder identification at every 180° CA, and specifies K of No K cylinder, and performs the flow chart of FIG. 10, by using the newly obtained, indicated mean effective pressure $P_{i(k)(i)}$. Explanation will be given by generalizing the respective cylinder as No. k cylinder.

First of all, in Step 101, the operation receives the engine revolution number $N_{e(i)}$ obtained from the signal X3 of the crank angle sensor 16 and the intake air quantity $Q_{(i)}$ obtained from the signal X1 of the air-flow meter 9 as state quantities for determining the running condition of the engine. Furthermore, the operation receives the inner cylinder pressure signal $X4_{(k)}$ obtained from the pressure sensor $19_{(k)}$, and the indicated mean effective pressure $P_{i(k)(i)}$ from the signal X3 of the crank angle sensor 16 at every interruption signal, mentioned above.

Next, in Step 102, the value of flag $F1_{(k)}$ mentioned above, is checked. When flag $F1_{(k)}$=S0 (initial state), the operation goes to Step 106. When NOT flag $F1_{(k)}$=S0, the operation goes to Step 103. In Step 103, a check is made on whether the engine speed $N_{e(i)}$ is the same with the engine speed $N_{es}$ of the preceding calculation, and the intake air quantity $Q_{(i)}$ is the same with the intake air quantity $Q_s$ of the preceding calculation. In this Step although not shown in the flow chart, the judgment of $N_{es}=N_{e(i)}$, and $Q_s=Q_{(i)}$, may be made with a predetermined width of a dead zone. For instance, $\lvert\Delta Ne\rvert$ is the dead zone width threshold value, and when the following equation is established, $$\lvert N_{es} - N_{e(i)}\rvert \leqq \lvert N_e\rvert$$

a judgment is made as $N_{es}=N_{e(i)}$. Similarly, in case of $Q_s=Q_{(i)}$, by using the dead zone width threshold value of $\lvert\Delta Qs\rvert$, and when the following equation established, $$\lvert Q_s - Q_{(i)}\rvert \leqq \lvert\Delta Q_s\rvert$$

a judgment is made as $Q_s=Q_{(i)}$. In Step 103, when NOT $N_{es}=N_{e(i)}$, and NOT $Q_s=Q_{(i)}$, the running condition in not in steady state, and the operation goes to Step 104. In case of the steady state of running condition, wherein $N_{es}=N_{e(i)}$, and $Q_s=Q_{(i)}$, the operation goes to Step 105.

In Step 105, an averaging treatment of the $P_{i(k)}$ value is performed using the currently measured $P_{i(k)}$ value. The averaging of the indicated mean effective pressure is performed to absorb a variation of the value at every measurement, caused by the change with cycle of the combustion of the engine or the variation with cylinders and so on, as mentioned before.

Although not described in flow chart, the averaging treatment method of the indicated mean effective pressure $P_{i(k)}$ is as follows. The method of the indicated mean effective pressure $P_{i(k)}$ which is measured until the preceding time, is as follows. (The summation of the indicated mean effective pressure $P_{i(k)}$, which is measured until the preceding time, is $SP_{i(k)(i-l)}$.) The summation of $P_{i(k)}$ which is measured until this time, $SP_{i(k)(i)}$ is obtained by the equation $SP_{i(k)(i)}=SP_{i(k)(i-l)}P_{i(k)(i)}$ In this equation the notation $_{(i)}$ signifies the current measured value or the current treated value, the notation $_{(i-l)}$ signifies the preceding measured value signifies that it belongs to No. k cylinder. After the treatment is finished, the averaging number counter $C_{pi(k)}$ (hereinafter $CP_{i(k)}$) is incremented. When $CP_{i(k)}=NC_{pi}$ (a predetermined value), the averaging is finished, and $C_{pi(k)}=0$. When $C_{pi(k)}\neq NC_{pi}$, the averaging is not finished. $NC_{pi(k)}$ which is used in the above calculation, is the number of averaging, which is as mentioned above, the number which can absorb the variation of the value of $P_{i(k)}$. When $C_{pi(k)}=NC_{pi}$, the indicated mean effective pressure averaged with respect to No. k cylinder $P_{iAve(k)}$, Calculated by the following equation.

$$P_{i(k)AVE}=SP_{i(k)(i:NCpI)}/NC_{pi}$$

By the above operation the averaging treatment of the indicated mean effective pressure can be carried out.

Next, the operation goes to Step 107. In Step 107, when the averaging treatment as mentioned above is finished, $C_{pi(k)}=0$. Therefore a judgment is made on whether the averaging is finished, according to the value of $C_{pi(k)}$ When a judgment is made as the averaging treatment is finished, the operation goes to Step 108. When a judgment is made as the averaging treatment is not finished, the operation goes to Step 111.

In Step 108, the difference between the preceding measured and averaged indicated mean effective pressure $P_{i(k)AVE(i-l)}$ and the current value of $P_{i(k)AVE(i)}$ is calculated by the following equation, and the operation calculates the above indicated mean effective pressure difference $\Delta P_{i(k)}$.

$$\Delta P_{i(k)}=P_{i(k)AVE(i)}-P_{i(k)AVE(i-l)}$$

The preceding $P_{i(k)AVE(i-l)}$ is renewed to the current Value of $P_{i(k)AVE(i)}$. When flag $F1_{(k)}=S10$, the value corresponds to the preceding $P_{i(k)AVE(i-l)}$ does not exist. Because when $F1_{(k)}=S10$, $P_{i(k)AVE(i)}$ is calculated by measuring $P_{i(k)}$ value. Therefore, when $F1_{(k)}=S10$, in the above calculation of $\Delta P_{i(k)}$, a predetermined value is inputted to $P_{i(k)AVE(i-l)}$, or $\Delta P_{i(k)}$ is not calculated. Because in the following treatment, when $F1_{(k)}=S10$, the value of $\Delta P_{i(k)}$ is not utilized in the treatment. After $\Delta P_{i(k)}$ is calculated and the value of $P_{i(k)EVE}$ is renewed, the operation goes to Step 109.

In Step 109, investigation is made on flag $F1_{(k)}$. When $F1_{(k)}=S2$, the mean value of the indicated mean effective pressure is set to a maximum air-fuel ratio, and the operation goes to Step 112. When $F1_{(k)}\neq S2$, flag $F1_{(k)}$ is still the case of S10 to S1A, the operation goes to Step 110, to perform treatment for determining the air-fuel ratio by which the mean value of the indicated mean effective pressure is maximized.

In Step 110, the operation identifies flag $F1_{(k)}$. The operation performs the treatment according to this flag $F1_{(k)}$, and the content of flag $F1_{(k)}$. The operation performs the treatment for determining the air-fuel ratio in which the indicated mean effective pressure is maximized, as explained following Table 1 and Table 2. Explanation will be given later on the detailed content of the treatment, according to FIG. 11 to FIG. 21, for respective treatment, according to the content of flag $F1_{(k)}$. After processing of the treatment according to the content of flag $F1_{(k)}$, in Step 110, the operation goes to Step 111.

In Step 111, the fuel injection quantity $Ti_{(k)}$ is determined by the equation (4) and controlled to the desired the air-fuel ratio using the air-fuel ratio correction coefficient $C_{AF(k)}$, or $C_{AF(k)}$ which is set until the preceding calculation, or the initialized $C_{AF(k)}$, as $C_{AF(k)}=1.0$. The current treatment is finished.

In Step 104, the air-fuel ratio correction coefficient $C_{AF(k)}$ is initialized, or $C_{AF(k)}=1.0$, and the operation goes to Step 106.

In Step 106, the state is after the running condition is changed, or is a totally initial state. Therefore, the engine speed $N_{es}$ which is a standard for judging that the running condition is in steady state, and the intake air quantity $Q_s$ which is a standard for judging that the running condition is in steady state, are reset. The averaging treatment of the value of $P_{i(k)}$ is started. As an initialization of the averaging treatment of the value of $P_{i(k)}$, $SP_{i(k)}=0$. Flag $F1_{(k)}$ is set as $F1_{(k)}=S10$. The operation goes to Step 111.

In Step 112, the operation is carried out to detect whether the said air-fuel ratio is considerably deviated from the set value, for some reason, after the air-fuel ratio is set, which maximizes $P_{i(k)}$, in S10 to SlA. In this Step, a check is made on $|\Delta P_{i(k)(i)}|\leqq|\Delta P_{ip}|$. When the above equation is established, the operation goes to Step 111. When the above equation is not established, the operation goes to Step 113.

In Step 113, flag $F1_{(k)}$ is set as S0, and the operation goes to Step 111. In this case, $P_{i(k)}$ value is considerably varied, for some reason, in spite of the same set air-fuel ratio correction coefficient, after the operation reaches the converging state S2. In Step 111, the air-fuel ratio is set to a value by which the mean value of the indicate mean effective pressure $P_{i(k)}$ is maximized again. In this case, the air-fuel ratio correction coefficient $C_{AF(k)}$ is not initialized, and the preceding set value is used.

As mentioned above, a logic which determines the air-fuel ratio that maximizes the mean value of the indicated means effective pressure $P_{i(k)}$, is explained. Although not shown in the flow chart of FIG. 10, when the operation does not perform the treatment for determining the air fuel ratio which maximizes the mean value of $P_{i(k)}$, the air-fuel ratio correction coefficient is initialized as $C_{AF(k)}=1.0$, the fuel injection quantity $TI_{(k)}$ is determined according to the equation (4).

Explanation will be given in details as for the above mentioned treatment of Step 110 in FIG. 10, by the flow charts of FIGS. 11 to 21.

Figure 11:
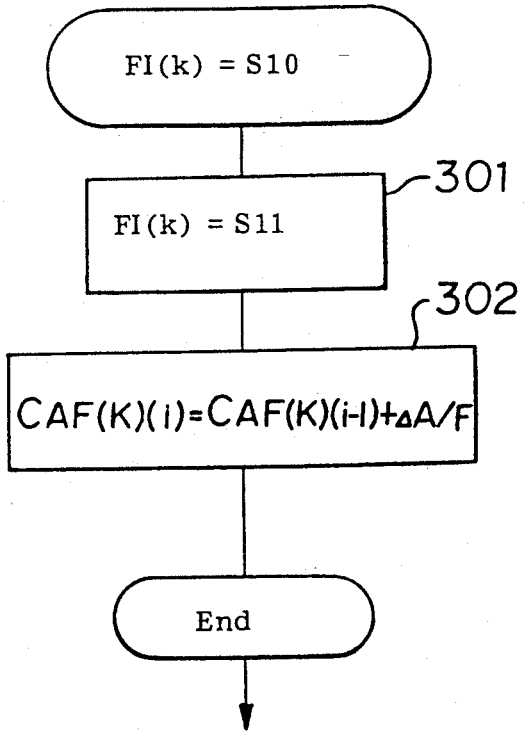
FIGS. 11 to 21 are flow charts showing the treatment procedure corresponding to each flag in Table 2.

The case of $F1_{(k)}=S10$ is shown in FIG. 11. In Step 301, $F1_{(k)}=S11$, and the operation goes to Step 302. In Step 302, $C_{AF(k)(i)}=C_{AF(k)(i-1)}+\Delta A/F$, and treatment for the case $F1_{(k)}=S10$ is finished.

Figure 12:
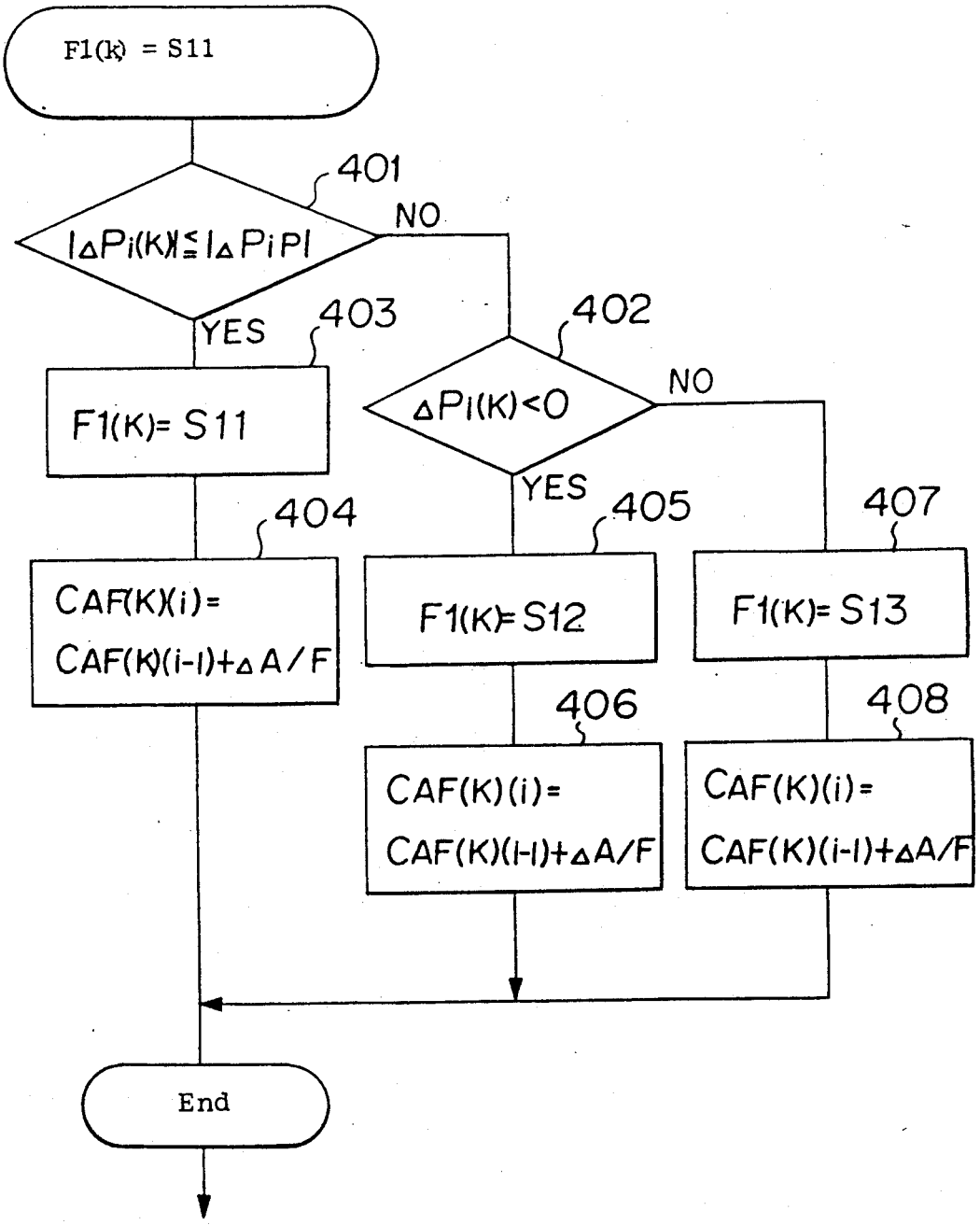

Next, referring to FIG. 12, explanation will be given to the case of $F1_{(k)}=S11$. In Step 401 a judgment is made whether $|\Delta P_{i(k)} \leqq Pip|$, or whether the absolute value of the indicated mean effective pressure difference is equal to or below $|Pip|$. If the above condition is not established, the averaged mean effective pressure $P_{i(k)}$ is increasing or decreasing, and the operation goes to Step 402. When the above condition is established, the mean value of the indicated mean effective pressure is in the region of its maximum value (for instance in the region of ② to ⑦ in FIG. 9), the operation goes to Step 403.

In Step 403, $F1_{(k)}=S11$. In Step 404, $C_{AF(k)(i)}$ is set as $C_{AF(k)(i)}=CA_{F(k)(i-1)}+\Delta A/F$, or $\Delta A/F$ =RICH.

In Step 402, the increase or decrease Of $\Delta P_{i(k)}$ is determined, by judging on whether $\Delta P_{i(k)}<0$, or the indicated mean effective pressure difference $\Delta P_{i(k)}$ is negative or positive. When the above condition is established, and $\Delta P_{i(k)}$ is negative, the operation goes to Step 405. When the above condition is not established and $\Delta P_{i(k)}$ is not negative, the operation goes Step 407.

In Step 405, flag $F1_{(k)}$ is set as $F1_{(k)}=S12$. In Step 406, $C_{AF(k)(i)}=C_{AF(k)(i-1)}-\Delta A/F$, or $\Delta A/F$ =LEAN.

In Step 407, flag $F1_{(k)}$ is set as $F1_{(k)}=S13$. In Step 408, $C_{AF(k)(i)}=C_{AF(k)(i-1)}+\Delta A/F$.

The operation is finished after Step 404, or Step 406, or Step 408.

Figure 13:
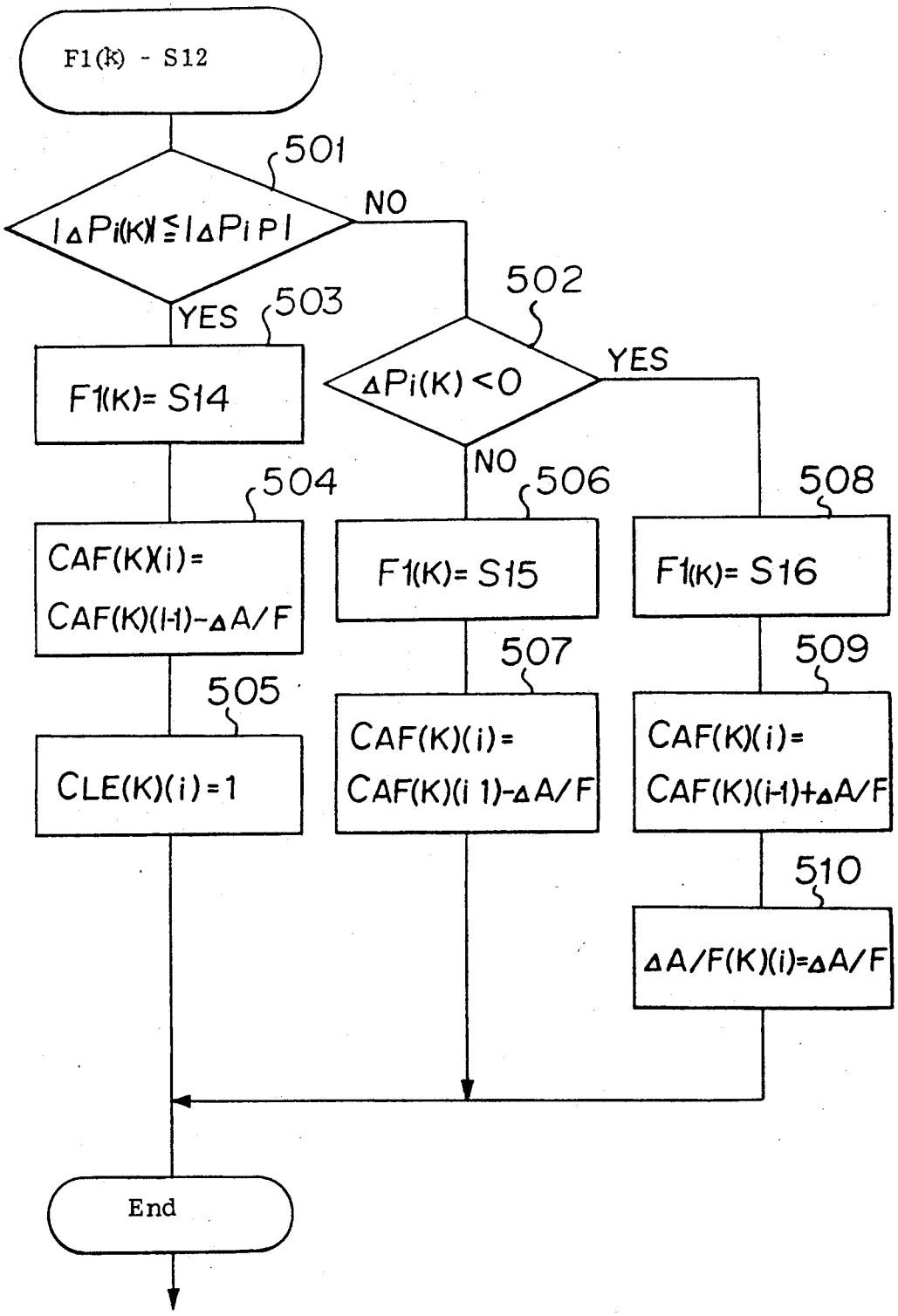

Next, referring to FIG. 13, explanation will be given to the case of $F1_{(k)}=S12$. First of all, in Step 501, a judgment is made on whether $|\Delta Pi(k) \leqq |\Delta Pip|$. When the above condition is not established, the operation goes to Step 502. When the above condition is established, the operation goes to Step 503.

In Step 503, flag $F1_{(k)}$ is set as $F1_{(k)}=S14$. In next Step 504, $C_{AF(k)(i)}$ is renewed as $C_{AF(k)(i)}=C_{AF(k)(i-1)}-\Delta A/F$. Furthermore, in Step 505, the number of making $C_{Le(k)(i)}$, or the number of "LEAN", is set as $C_{Le(k)(i)}=1$, and counting begins.

In Step 502, a judgment is made on whether $\Delta P_{i(k)}<0$. When the above condition is not established, the operation goes to Step 506. When the above condition is established, the operation goes to Step 508.

In Step 506, flag $F1_{(k)}$ is set as $F1_{(k)}=S15$. In Step 507, $C_{AF(k)(i)}$ renewed as $C_{AF(k)(i)}=C_{AF(k)(i-1)}-\Delta A/F$.

In Step 508, flag $F1_{(k)}$ is set as $F1_{(k)}=S16$. In Step 509, $C_{AF(k)(i)}$ is renewed as $C_{AF(k)(i)}=C_{AF(k)(i-1)}+\Delta A/F$. *In Step* 510, $\Delta A/F(k)(i)$ is set as $\Delta A/F_{(k)(i)}=\Delta A/F$.

The operation is finished after Step 505, or Step 507, or Step 510.

Figure 14:
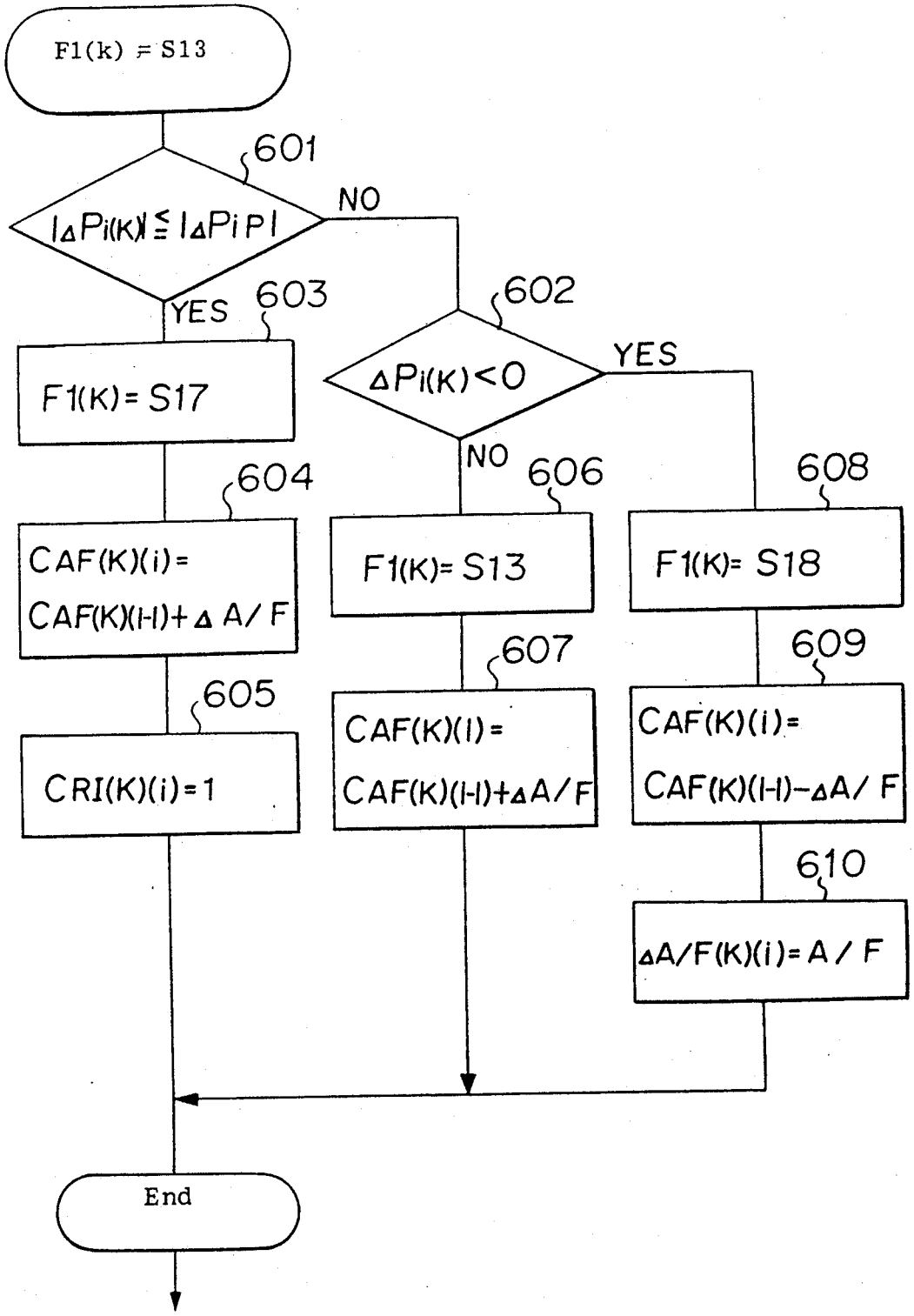
Figure 15:
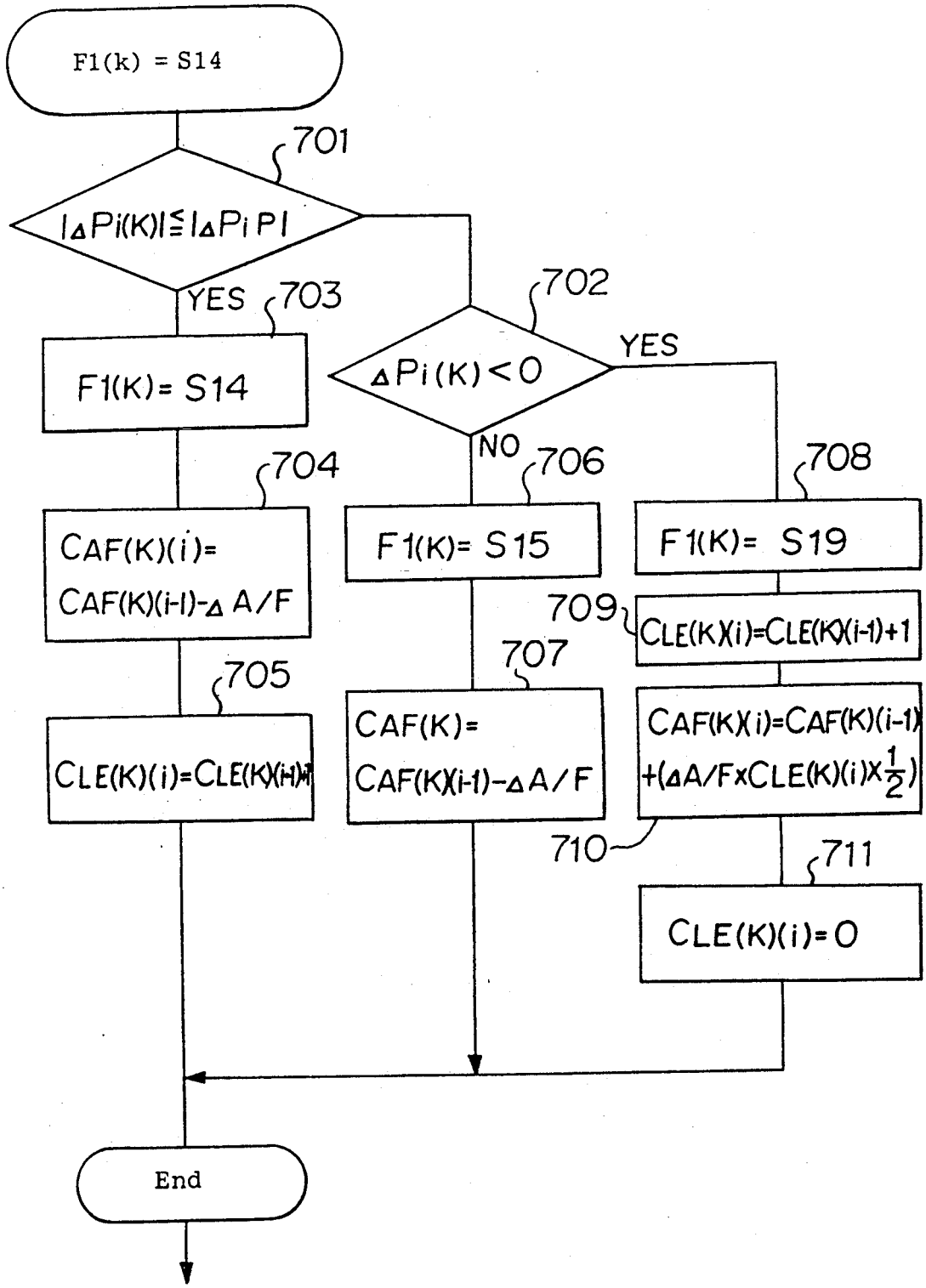

Next, referring to FIG. 14, explanation will be given the case of $F1_{(k)}=S13$. First of all, in Step 601, a judgment is made on whether $|\Delta P_{i(k)} \leqq |\Delta P_{iP}|$. When the above condition is not established, the operation goes to Step 602. When the above condition is established, the operation goes to Step 603.

In Step 603, flag $F1_{(k)}$ is set as $F1_{(k)}=S17$. In Step 604, $C_{AF(k)(i)}$ is renewed as $C_{AF(k)(i)}=C_{AF(k)(i-1)}+\Delta A/F$. In step 605, the number of times for making $C_{AF(k)(i)}$ "RICH" is set as $C_{RI(k)(i)}=1$, and counting begins.

In Step 602, a judgment is made on whether $\Delta P_{i(k)}<0$. When the above condition is not established, the operation goes to Step 606. When the above condition is established, the operation goes to Step 608.

In Step 606, flag $F1_{(k)}$ is set as $F1_{(k)}=S13$. In Step 607, $C_{AF(k)(i)}$ is renewed as $C_{AF(k)(i)}=C_{AF(k)(i-1)}+\Delta A/F$ or $\Delta A/F$ =RICH. In Step 608, flag $F1_{(k)}$ is set as $F1_{(k)}=S18$. In Step 609, $C_{AF(k)(i)}$ is renewed as $C_{AF(k)(i)}=C_{AF(k)(i-1)}-\Delta A/F$, or $\Delta A/F$ =LEAN. In Step 610, $\Delta A/F_{(k)(i)}$ is set as $\Delta A/F_{(k)(i)}=\Delta A/F$.

The operation is finished after treating Step 605, or Step 607, or Step 610.

Next, explanation will be given to the case of $F1_{(k)}$ S14. In Step 701, a judgment is made on whether $|\Delta P_{i(k)}| \leqq |\Delta P_{ip}|$. When the above condition is not established, the operation goes to Step 702. When the above condition is established, the operation goes to Step 703.

In Step 703, flag $F1_{(k)}$ is set as $F1_{(k)}=S14$. In Step 704, $C_{AF(k)(i)}$ is renewed as $C_{AF(k)(i)}=C_{AF(k)(i-1)}\Delta A/F$. Furthermore, in Step 705, $C_{LE(k)(i)}$ is renewed as $C_{LE(k)(i)}=C_{LE(k)(i-1)}+1$.

In Step 702, the judgment is made whether $\Delta P_{i(k)}<0$. When the above condition is not established, the operation goes to Step 706. When the above condition is established, the operation goes to Step 708.

In Step 706, flag $F1_{(k)}$ is set as $F1_{(k)}=S15$. In next Step 707, $C_{AF(k)(i)}$ is renewed as $C_{AF(k)(i)}=C_{AF(k)(i-1)}-\Delta A/F$.

In Step 708, flag $F1_{(k)}$ is set as $F1_{(k)}=S19$. In Step 709, $C_{LE(k)(i)}$ is renewed as $C_{LE(k)(i)}=C_{LE(k)(i-1)}+1$. In next Step 710, $C_{AF(k)(i)}$ is renewed as $C_{AF(k)(i)}=C_{AF(k)(i-1)}=\Delta A/F\times C_{LE(k)(i)}\times\frac{1}{2}$. Furthermore, in next Step 711, $C_{LE(k)(i)}$ is Set as $C_{LE(k)(i)}=0$.

The operation is finished after the treating Step 705, or Step 707, or Step 711.

Figure 16:
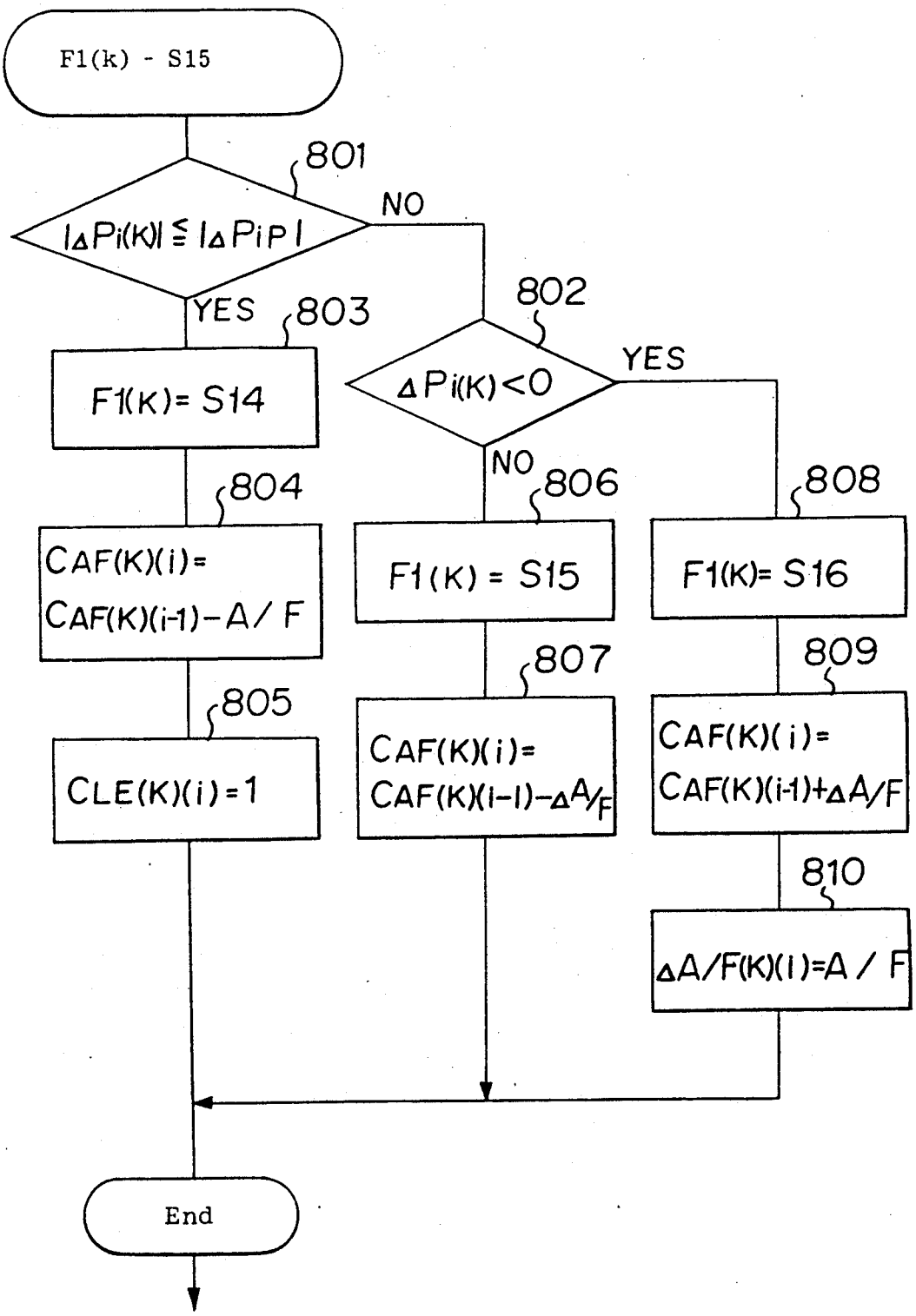

Next, referring to FIG. 16, explanation will be given on the case of $F1_{(k)}=S15$. In Step 801, a judgment is made on whether $|\Delta P_{i(k)}| \leqq \Delta P_{iP}|$. When the above condition is not established, the operation goes to Step 802. When the above condition is established, the operation goes to Step 803.

In Step 803, $F1_{(k)}$ is set as $F1_{(k)}=S14$. In Step 804, $C_{AF(k)(i)}$ is renewed as $C_{AF(k)(i)}=C_{AF(k)(i-1)}\Delta A/F$. Furthermore, in Step 805, $C_{LE(k)(i)}$ is Set as $C_{LE(k)(i)}=1$, and counting begins.

In Step 802, a judgment is made on whether $\Delta P_{i(k)}<0$. When the above condition is not established, the operation goes to Step 806. When the above condition is established, the operation goes to Step 808.

In Step 806, flag $F1_{(k)}$ is set as $F1_{(k)}=S15$. In Step 807, $C_{AF(k)(i)}$ is renewed as $C_{AF(k)(i)}=C_{AF(k)(i-1)}\Delta A/F$.

In Step 808, flag $F1_{(k)}$ is set as $F1_{(k)}=S16$. In Step 809, $C_{AF(k)(i)}$ is renewed as $C_{AF(k)(i)}=C_{AF(k)(i-1)}+\Delta A/F$. Furthermore, in Step 810, $\Delta A/F_{(k)(i)}$ is set as $\Delta A/F_{(k)(i)}=\Delta A/F$.

The operation is finished after treating Step 805, or Step 807, or Step 810.

Figure 17:
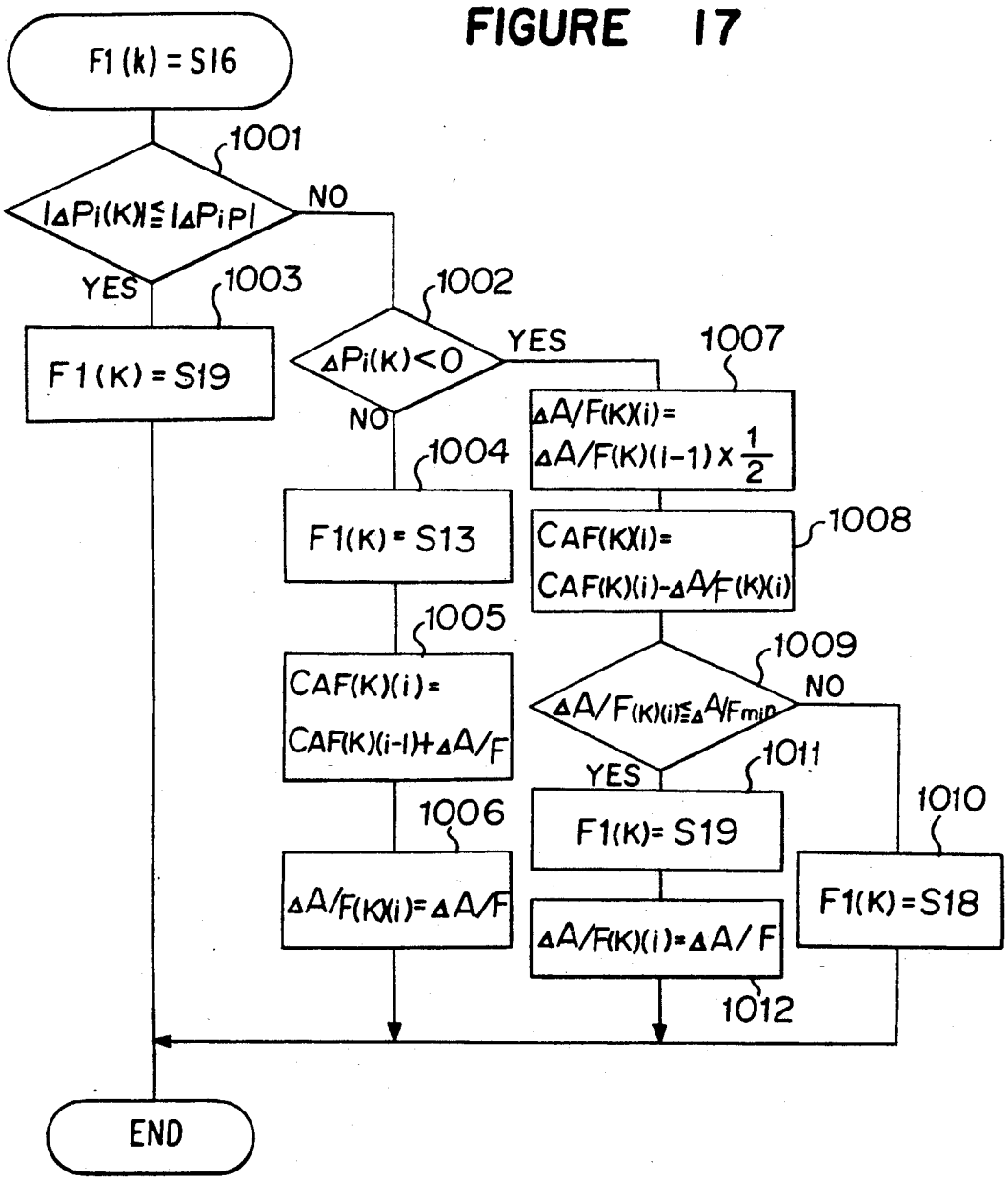

Next, referring to FIG. 17, explanation will be given to the case of $F1_{(k)}=S16$. In Step 1001, a judgment is made on whether $|\Delta P_{i(k)}|\Delta P_{iP}|$. When the above condition is not established, the operation goes to Step 1002. When the above condition is established, the operation goes to Step 1003.

In Step 1003, flag $F1_{(k)}$ is set as $F1_{(k)}=S19$. In Step 1002, a judgment is made on whether $\Delta P_{i(k)}<0$. When the above condition is not established, the operation goes to Step 1004. When the above condition is established, the operation goes to Step 1007.

In Step 1004, flag $F1_{(k)}$ is set as $F1_{(k)}=S13$. In next Step 1005, $C_{AF(k)(i)}$ is renewed as $C_{AF(k)(i)}=C_{AF(k)(i-1)}+\Delta A/F$. In next Step 1006, $\Delta A/F_{(k)(i)}$ is set as $\Delta A/F_{(k)(i)}=\Delta A/F$.

In Step 1007, $\Delta A/F_{(k)(i)}$ is made as $\Delta A/F_{(k)(i)}=\Delta A/F(k)(i-1)\times\frac{1}{2}$. In next Step 1008, $C_{AF(k)(i)}$ is renewed as $C_{AF(k)(i)}=C_{AF(k)(i-1)}-\Delta A/F_{(k)(i)}$ In Step 1009, a judgment is made on whether $\Delta A/F_{(k)(i)}\leqq A/F_{min}$ (a predetermined value). When the above condition is not established, in Step 1010, flag $F1_{(k)}$ is set as $F1_{(k)}=S18$. When the above condition is established, in Step 1011, flag $F1_{(k)}$ is set as $F1_{(k)}=S19$. In Step 1012, $\Delta A/F_{(k)(i)}$ is set as $\Delta A/F_{(k)(i)}=\Delta A/F$.

The operation is finished after treating Step 1003, or Step 1006, or Step 1010, or Step 1012.

As mentioned above, when $F1_{(k)}=S16$, and when $F1_{(k)}=S18$, mentioned later, there may be cases in which the direction of the change of the air-fuel ratio is alternated between "rich" and "lean". When $\Delta P_{i(k)}$ is decreasing, the size of $\Delta A/F$ is made smaller. That is, $\Delta A/F_{(k)(i)}$ made as $\Delta A/F_{(k)(i)}=\Delta A/F(k)(i-1)\times\frac{1}{2}$. When $\Delta A/F_{(k)(i)}$ becomes smaller than a predetermined $\Delta A/F_{min}$, the value of $\Delta A/F$ is judged as almost 0. In this case, flag $F1_{(k)}$ is set as S19, and $C_{AF(k)(i)}=C_{AF(k)(i-1)}-\Delta A/F_{(k)(i)}$.

When $\Delta A/F_{(k)(i)}$ is larger than $\Delta A/F_{min}$, flag $F1_{(k)}$ is set as S18, and $CAF(k\}(i)=C_{AF(k)(i-1)}-\Delta A/F_{(k)(i)}$.

Figure 18:
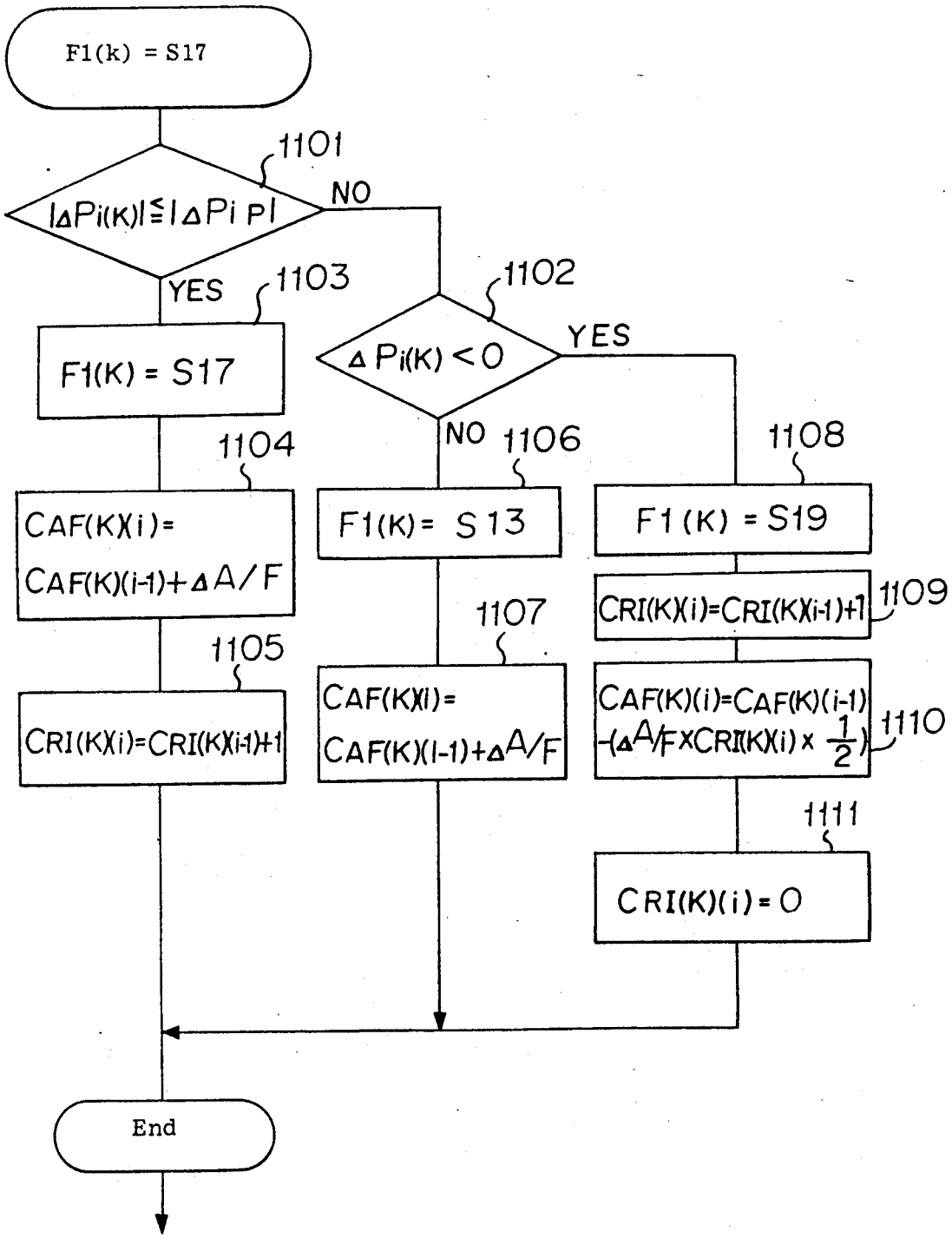

Next, referring to FIG. 18, explanation will be given to the case of $F1_{(k)}=S17$. First of all, in Step 1101, a judgment is made on whether $|\Delta P_{i(k)}|\leqq|\Delta P_{iP}|$. When the above condition is not established, the operation goes to Step 1102. When the above condition is established, the operation goes to Step 1103.

In Step 1103, flag $F1_{(k)}$ is set as $F1_{(k)}=S17$. In next Step 1104, $C_{AF(k)(i)}$ is Set as $C_{AF(k)(i)}=C_{AF(k)(i-1)}+\Delta A/F$. Furthermore, in Step 1105, $C_{RI(k)(i)}$ is renewed as $C_{RI(k)(i)}=C_{RI(k)(i-1)}+1$.

In Step 1102, a judgment is made whether $\Delta P_{i(k)}<0$. When the above condition is not established, the operation goes to Step 1106. When the above condition is established, the operation goes to Step 1108.

In Step 1106, flag $F1_{(k)}$ is set as $F1_{(k)}=S13$. In next 1107, $C_{AF(k)(i)}$ is set as $C_{AF(k)(i)}=C_{AF(k)(i-1)}+\Delta A/F$.

In Step 1108, flag $F1_{(k)}$ is set as $F1_{(k)}=S19$. In next Step 1109, $C_{RI(k)(i)}$ is renewed as $C_{RI(k)(i)}=C_{RI(k)(i-1)}+1$. Furthermore, in Step 1110, $C_{AF(k)(i)}$ is set as $C_{AF(k)(i)}=C_{AF(k)(i-1)}-\Delta A/F\times C_{RI(k)(i)}\times\frac{1}{2}$. In Step 1111, $C_{AF(k)(i)}$ is Set as $C_{AF(k)(i)}=0$. The operation is finished after treating above Step 1105, or Step 1107, or Step 1111.

Figure 19:
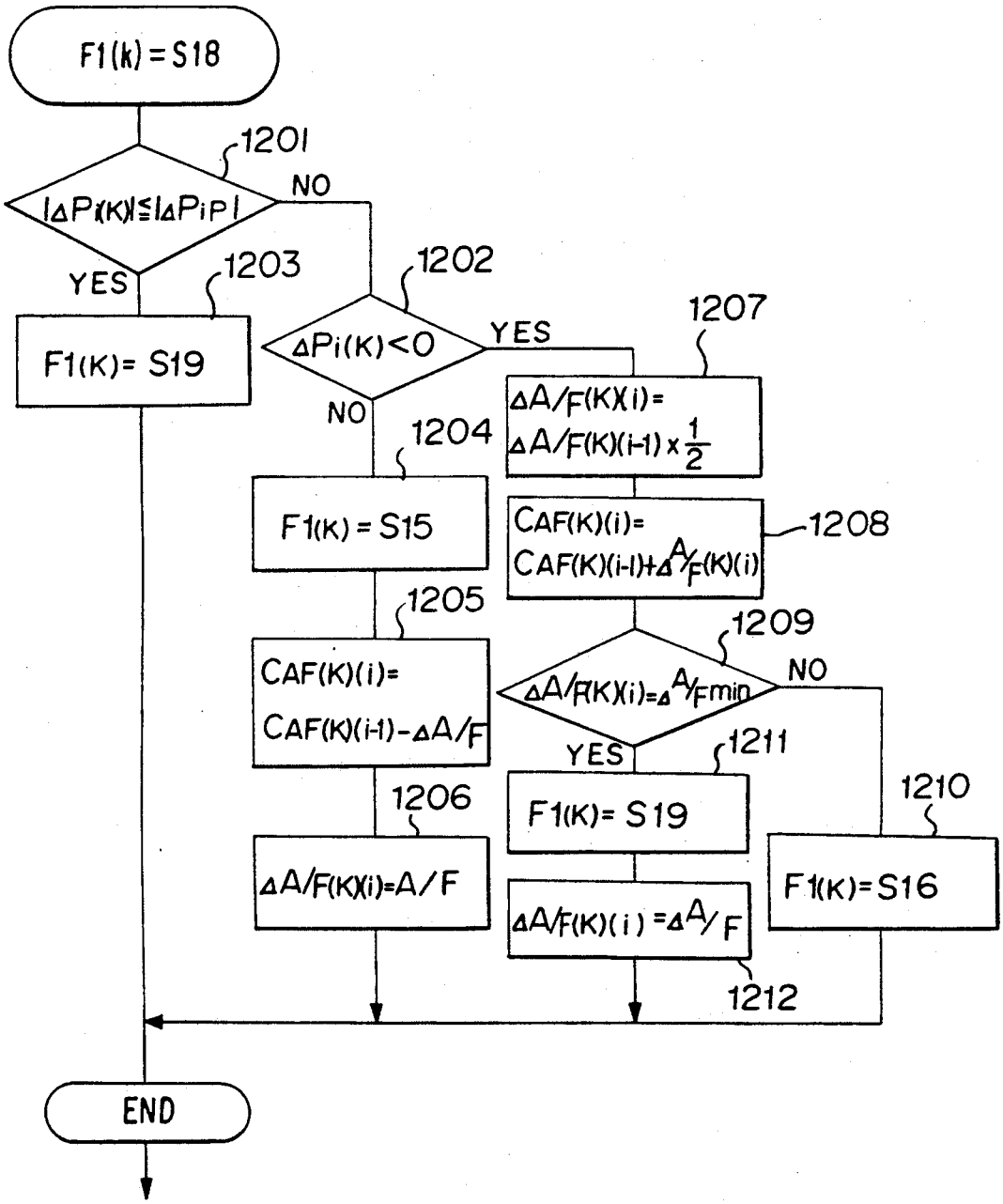

Next, referring to FIG. 19, explanation will be given to the case of $F1_{(k)}=S18$. In Step 1201, a judgment is made on whether $|\Delta P_{i(k)}|\leqq|\Delta P_{iP}|$. When the above condition is not established, the operation goes to Step 1202. When the above condition is established, the operation goes to Step 1203, and flag $F1_{(k)}$ is set as $F1_{(k)}=S19$.

In Step 1202, a judgment is made on whether $\Delta P_{i(k)}<0$. When the above condition is not established, the operation goes to Step 1204. When the above condition is established, the operation goes to Step 1207. In Step 1204, flag $F1_{(k)}$ is set as $F1_{(k)}=S15$. In next Step 1205, $C_{AF(k)(i)}$ is renewed as $C_{AF(k)(i)}=C_{AF(k)(i-1)}-\Delta A/F$. Furthermore, in Step 1206, $\Delta A/F_{(k)(i)}$ is set as $\Delta A/F_{(k)(i)}=\Delta A/F$. In Step 1207, $\Delta A/F_{(k)(i)}$ set as $\Delta A/F_{(k)(i)}=\Delta A/F_{(k)(i-1)}\times\frac{1}{2}$. In next Step 1208, $C_{AF(k)(i)}$ is renewed as $C_{AF(k)(i)}=C_{AF(k)(i-1)}+\Delta A/F_{(k)(i)}$. Furthermore, in Step 1209, a judgment is made on whether $\Delta A/F_{(k)(i)}\leqq A/F_{min}$. When the above condition is not established, the operation goes to Step 1210, and flag $F1_{(k)}$ is set as $F1_{(k)}=S16$. When the above condition is established, in Step 1211, flag $F1_{(k)}$ is set as $F1_{(k)}=S19$. In Step 1212, $\Delta A/F_{(k)(i)}$ is set as $\Delta A/F_{(k)(i)}=\Delta A/F$.

The operation is finished after treating the above Step 1203, or Step 1206, or 1210, or Step 1212.

Figure 20:
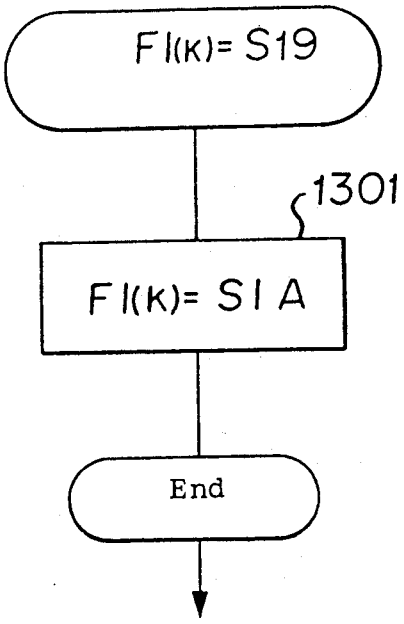

Next, referring to FIG. 20, explanation will be given to the case of $F1_{(k)}=S19$. In Step 1301, flag $F1_{(k)}$ is set as $F1_{(k)}$ SlA, and the operation is finished.

Figure 21:
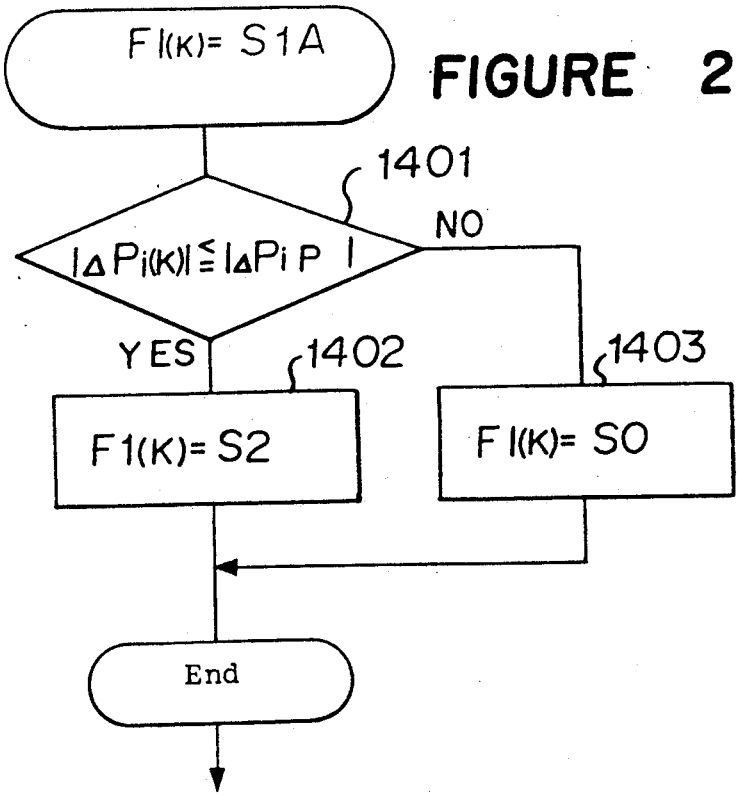

Next, referring to FIG. 21, explanation will be given to the case of $F1_{(k)}=SlA$. First of all, in Step 1401, a judgment is made on whether $|\Delta P_{i(k)}|\leqq|\Delta P_{iP}|$. When the above condition is established, in Step 1402, flag $F1_{(k)}$ is set as $F1_{(k)}=S2$, and the operation is finished. When the above condition is not established, in Step 1403, flag Fl is set as Fl =S0, the operation is finished.

As mentioned above, when a treatment is made following the block diagram in FIG. 5 which shows the function of the operation, and flow charts shown in FIG. 10 to FIG. 21, the air-fuel ratio in which maximizes the average value of the indicated mean effective pressure, can be determined for respective cylinders independently, and the fuel injection quantity $T_i$ can be determined for respective cylinders.

In the above explanation, the air-fuel ratio which maximizes the average value of the indicated mean effective pressure of No. k cylinder, is determined by renewing the fuel injection quantity $T_{i(k)}$ of No. k cylinder utilizing the air-fuel ratio correction coefficient $C_{AF(k)}$ of No. k cylinder. The case in which the ignition timing is changed, as shown in FIG. 8, has the same characteristic with the case in which the air-fuel ratio is changed as in FIG. 7.

Accordingly, similar to the case in which the change of the average value of the indicated mean effective pressure is investigated by changing the air-fuel ratio, the ignition timing which maximizes the average value of the indicated mean effective pressure, can be determined for respective cylinders independently.

First of all, the basic advance angle value $SA_b$, as well known, can be determined by looking at a table, which is classified by the engine speed $N_e$ and the basic fuel injection quantity $T_P$.

By using the predetermined ignition advance angle change quantity $\Delta SA$ for this basic advance angle value $SA_b$, a signal to be sent to the ignition device 17 shown in FIG. 1, or, the advance angle value SA which determines the ignition signal X6, can be determined by the following equations (5) and (6)

$$SA=SA_b+\Delta SA \quad (5)$$

$$SA=SA_b-\Delta SA \quad (6)$$

Equation (5) is for the case of advance angle, in FIG. 8, for the case in which the value of the ignition timing is increasing to advance angle side. Equation (6) is for the case of retard angle, in FIG. 8, for the case in which the value of the ignition timing is decreasing to retard angle side.

As is clearly shown in the above equations (5) and (6), in order to replace the case in which the air-fuel ratio is set according to the flow charts shown in FIG. 10 to FIG. 21, mentioned above, with a case of ignition timing, the values for the case of the air-fuel ratio should be replaced with the values for the case of the ignition timing.

Accordingly, $C_{AF(k)(i)}$ is replaced with SA(k)(i), $\Delta A/F$, $\Delta SA$, $C_{AF(k)(i)}=1$, $SA_{(k)(i)}=SA_b$, and $\Delta A/F_{min}$, $\Delta SA_{min}$.

In Step 111 in FIG. 10, the fuel injection width $T_i$ is determined by the air-fuel correction coefficient $C_{AF}$. In case of advance ignition timing SA which is determined by the above equation (5) or equation (6), is set to the ignition device 16 shown in FIG. 1. As the case of the air-fuel ratio, when a control in which the maximizing of the average value of the indicated mean effective pressure by the ignition timing, is not carried out, the ignition advance angle is set to the value which determined by looking up a table. By determining the ignition advance angle SA by this way, the ignition advance angle is determined, by which the average value of the indicated mean effective pressure is maximized.

In the above first embodiment, the inner cylinder pressure cylinder is detected by using the pressure sensor 19. From this detected value the indicated mean effective pressure is obtained. The air-fuel ratio and or the ignition timing is determined by the feed back control, by maximizing the average value. Therefore, in spite of the variation or the timewise change of parts of the engine, or change in environment, the engine can be run in the condition of the optimum air-fuel ratio and or the optimum ignition timing, which have advantageous in enhancing the output torque.

No apprehension is caused in which the engine has a shortage of the output torque, or an instable operation.

Next, explanation will be given to a second embodiment of this invention. The hardware structure of this embodiment is the same with that as shown in FIGS 1 to 5, except that the function and operation of the control device 21 is different. The indicated mean effective pressure averaging means M7 obtains an average value of the indicated mean effective pressure, which is averaged further by sampling a predetermined number of values which averages, among cylinders, the indicated mean effective pressure of the respective cylinders of a plurality of cylinders of the engine. The difference of the second embodiment with the first embodiment is at a point in which the control means M9 controls the engine by determining at least one of the air-fuel ratio and the ignition timing, by maximizing the above average value of the indicated mean effective pressure.

Figure 22:
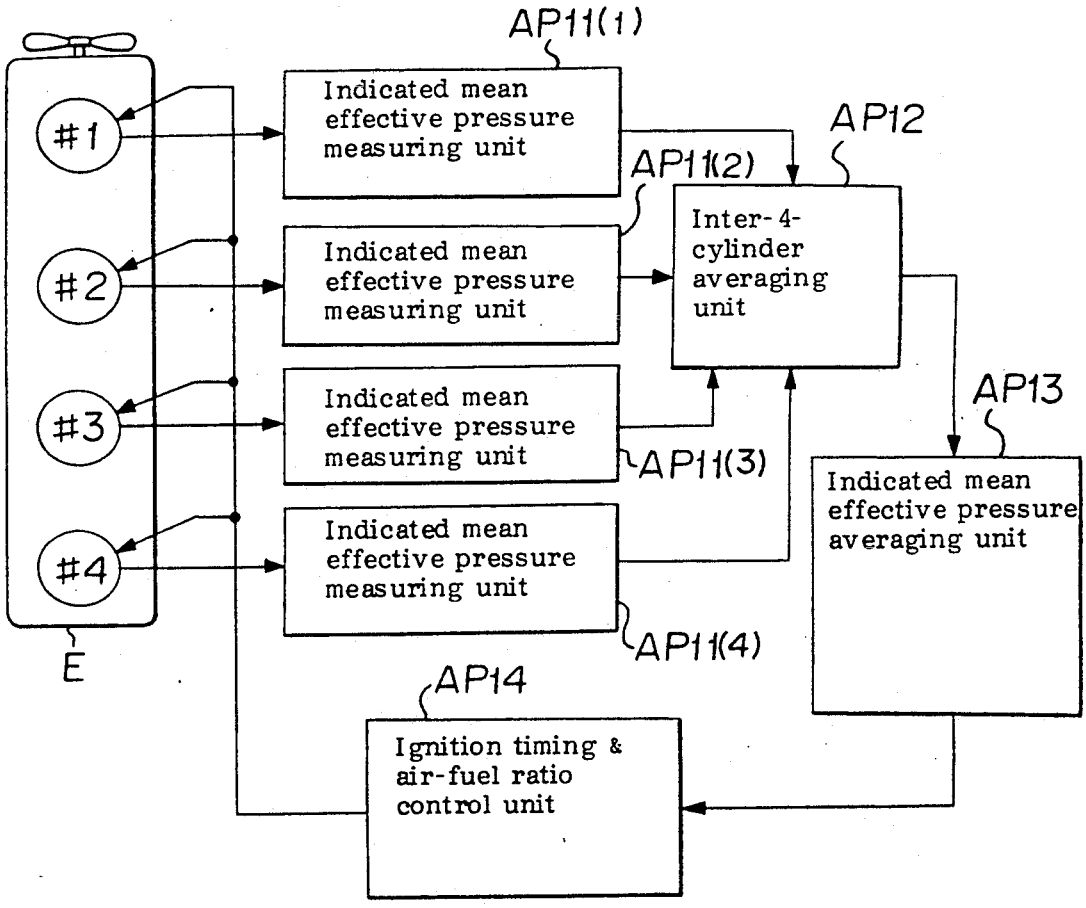
FIG. 22 is an outline diagram showing the outline structure of a second embodiment of the control device of the engine according to the present invention.
Figure 23:
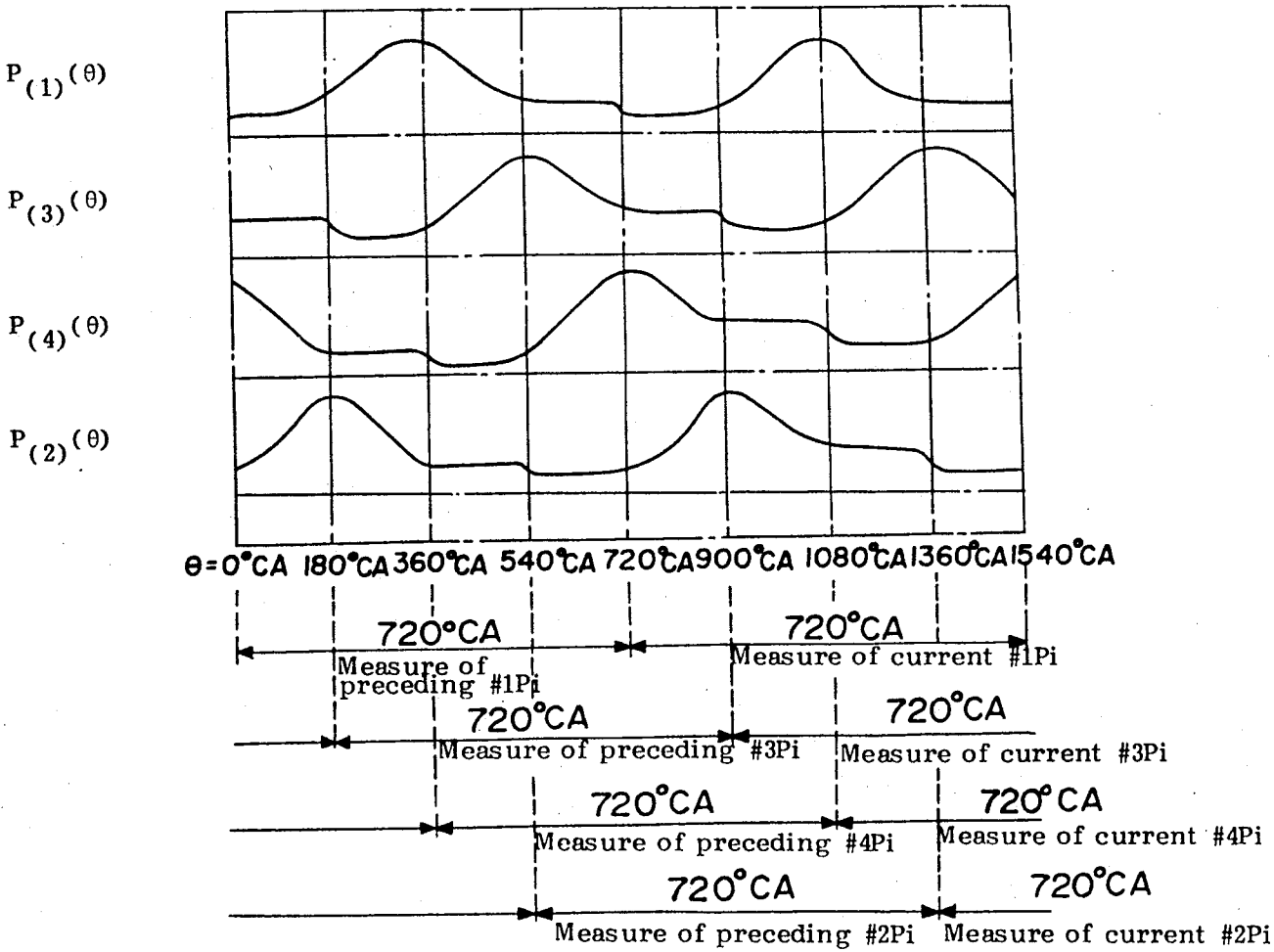
FIG. 23 is an explanatory diagram showing the measurement timing for the change of inner cylinder pressure and the indicated mean effective pressure for each cylinder in the second embodiment.

FIG. 22 is an outline diagram which shows important parts of the device in the above second embodiment. The indicated mean effective pressure measuring units $APll_{(l)}$ to $APll_{(4)}$, is installed, for instance, for respective cylinders of No. 1 cylinder #1 to No. 4 cylinder #4, and measures the indicated mean effective pressures for respective cylinders from the inner cylinder pressures of the respective cylinders. The inter-4-cylinder averaging unit AP12 receives the output of the indicated mean effective pressure measuring units $APll_{(1)}$to $APll_{(4)}$, averages for instance at every 720° CA, the indicated mean effective pressure among four cylinders, and outputs it. The indicated mean effective pressure timewise averaging unit AP13 receives the output of the inter-4-cylinder averaging unit, and under a certain running condition, averages timewisely the average value of the indicated mean effective pressure among four cylinders, and output it. The ignition timing and air-fuel ratio control unit AP14, based on the output of the indicated mean effective pressure timewise averaging unit AP13, and under a certain running condition, determines at least one of the ignition timing and the air-fuel ratio (in this embodiment, the air-fuel ratio) which maximizes the average value of the mean effective pressure, and controls the engine by a feed back control. FIG. 23 shows the measurement timing of the indicated mean effective pressure corresponding to the change of the inner cylinder pressure of No. a cylinder $P_{(a)}(\theta)$ ($\theta$ is a crank angle). In FIG. 23, as mentioned in the above first embodiment, measurement is repeated in order of No. 1 cylinder #1, No. 3 cylinder #3, No. 4 cylinder #4, and No. 2 cylinder #2, which is obtained for each cylinder at every 720 ©CA the indicated mean effective pressure, with phase lag of 180° CA among cylinders. Accordingly, at every 720° CA, the indicated mean effective pressure of all the four cylinders are obtained as for the one cycle of the respective cylinders. By adding and dividing by four the indicated mean effective pressures, the indicated mean effective pressure $P_i$ which is averaged among four cylinders, is obtained. At every timing in which the indicated mean effective pressure, averaged among four cylinders, is obtained, or at every 720° CA (every 2 revolutions of the engine), the flow charts which is same with the FIG. 10, should be carried out. In this case, the fuel injection is performed simultaneously with respect to all the cylinders.

The suffix$_{(k)}$ in FIG. 10 to 21, in the above first embodiment, is totally omitted, and in the explanation of the flow chart, the part concerning the suffix$_{(k)}$, or k should be omitted. $P_{i(k)}$ is replaced with $P_i$. This $P_i$ is regarded as the indicated mean effective pressure which is averaged among four cylinders. The difference between the current value of $P_{iAVE(i)}$ ($Pi_{(k)AVE(i)}$ in the first embodiment) which is averaged by sampling $P_i$, under steady state running condition, by a predetermined number $NC_{Pi}$, and the preceding value of $P_{iAVE(i-l)}$ ($P_{i(k)AVE(i-l)}$ in the first embodiment), represents the indicated mean effective pressure difference $\Delta P_i$ ($\Delta P_{i(k)}$ in the first embodiment). By replacing the notations, the second embodiment is self-evident from the first embodiment, and the explanation is omitted.

Of course the second embodiment can be applied to a control which determines not only the air-fuel ratio but the ignition timing, as in the first embodiment.

In the above explanation, the indicated mean effective pressure $P_i$ is obtained by averaging in one cycle. However, $P_i$ may be obtained by averaging in a plurality of cycles.

Next, explanation will be given to a third embodiment of the invention. The hardwear structure of this embodiment is the same with that shown in FIGS. 1 to 5, except that the function and the operation of the control device 21 is different. The control means M9 in FIG. 5 controls at least one of the air-fuel ratio and the ignition timing so that the average value of the indicated mean effective pressure of each cylinder agrees with a predetermined respective target value.

Figure 24:
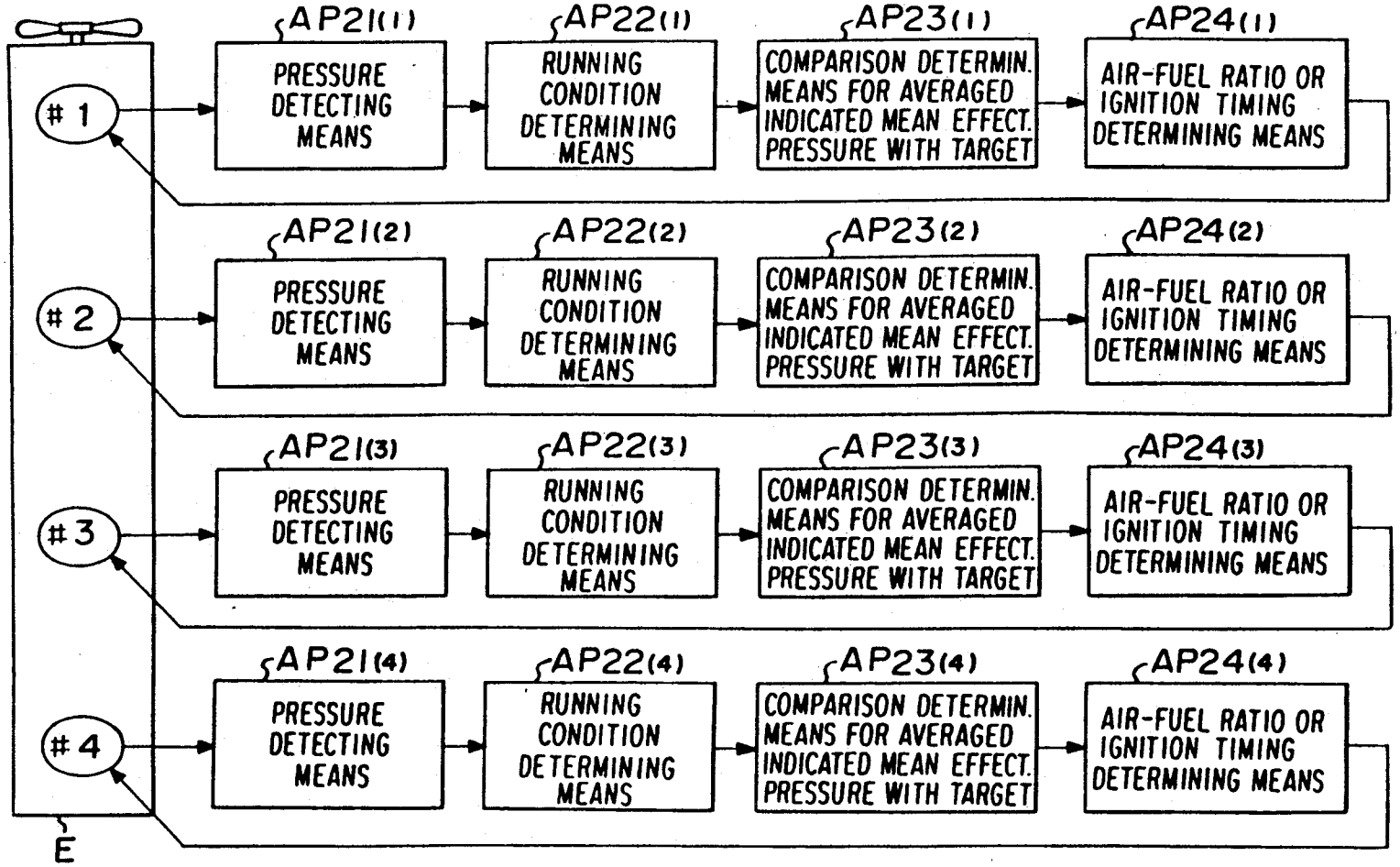
FIG. 24 is an outline diagram showing the outline structure of a third embodiment of the control apparatus of the engine according to the present invention.

FIG. 24 is an outline diagram showing the structure of the important parts of the device in the above third embodiment. The engine E is composed, for instance, of No. 1 cylinder #1 to No. 4 cylinder #4. The pressure detecting means AP21$_{(k)}$ are installed to the respective cylinders, and detect the respective inner cylinder pressures. The running condition determining means AP22$_{(k)}$ receive the outputs of the running condition detecting means, not shown, judge, for respective cylinders, on whether the running condition of the engine is in steady state, and output the outputs of the corresponding pressure detecting means AP21$_{(k)}$ when the running condition is in steady state. The comparison determining means $AP23_{(k)}$ for averaged indicated mean effective pressure with target, which compare the average value of the indicated mean effective pressure with a target value, obtain the average value of the indicated mean effective pressure for respective cylinders, based on the pressures for respective cylinders detected by the pressure detecting means $AP21_{(k)}$, and compare them with target values. The air-fuel ratio or ignition timing setting means $AP24_{(k)}$, set at least one of the air-fuel ratio and the ignition timing (the air-fuel ratio in this embodiment) corresponding to the result of the comparison, so that the average values of the indicated mean effective pressures approach the target value, and control the engine by a feed back control. The pressure detecting means $AP21_{(k)}$, the running condition determining means for averaged indicated mean effective pressure with target $AP23_{(k)}$ which compares the mean values of the indicated mean effective pressures with target values, and the air-fuel ratio or ignition timing setting means $AP24_{(k)}$, are provided for respective cylinders, and constitute independent closed loops for the respective cylinders (k of suffix$_{(k)}$ is an integer, for instance, in four cylinders engine, 1 to 4).

The flow chart in FIG. 25 is to be replaced with the flow chart in FIG. 10, which is initiated at every timing when the measurement of the indicated mean effective pressure of a cylinder is finished, for, at every 180 ©CA, in case of, for instance, four cylinder engine as in the flow chart of FIG. 10. Of course, before the initiation, as in the first embodiment, identification should be made on the respective cylinders, and k of No. k cylinder in current treatment, is specified.

First of all, in Step 121, the engine speed $N_{e(i)}$ and the intake air quantity $Q_{(i)}$ are read. Furthermore, the indicated mean effective pressure $P_{i(k)(i)}$ is read at every interruption.

Next, in Step 122, comparison is made between the current engine speed $N_{e(i)}$ and the current intake air quantity $Q_{(i)}$, and the preceding engine speed $N_{es}$ and intake air quantity $Q_s$ by using dead zone threshold values, and a judgment is made on whether the engine is in steady state running condition, in which $N_{e(i)}=N_{es}$ and $Q_{(i)}=Q_s$. When the engine is in steady state running condition, the operation goes to Step 123. When the engine is not in steady state running condition, the operation goes to Step 140.

In Step 123, a judgment is made on whether $F2_{(k)}=0$. When the above condition is not established, the operation goes to Step 124. When the above condition is established, the operation goes to Step 139.

In Step 139, the engine speed $N_{es}$ by which the engine is judged as in a steady state running condition, and the intake air quantity $Q_s$ by which the engine is in steady state running condition, are reset. As an initialization of the averaging treatment of the value of $P_{i(k)}$, the summation of the indicated mean effective pressure, $SP_{i(k)}$ is made as $SP_{i(k)}=0$. Flag $F2_{(k)}$ is set as $F2_{(k)}=1$. After the treatment in Step 139, the operation jumps to Step 137.

In Step 124, the averaging treatment of the indicated mean effective pressure $P_{i(k)}$, is performed.

After the averaging treatment, in Step 125, a judgment is made on whether the current averaging of $P_{i(k)}$ is finished. When the averaging is not finished, the operation jumps to Step 137. When the averaging is finished, the current average value $P_{i(k)AVE(i)}$ of the indicated mean effective pressure $P_{i(k)}$ is obtained, and the operation goes to next Step 126A. The above Step 124 and Step 125 correspond to Step 105 and Step 107 in FIG. 10, respectively, and mention is already given in the first embodiment, and the detailed explanation is omitted.

In Step 126A, the target value of the indicated mean effective pressure, $P_{ir(k)}$, of which zone corresponds to the running condition of $N_{e(i)}$ and $Q_{(i)}$, is read by mapping.

The target value of the indicated mean effective pressure $P_{ir(k)}$ is set beforehand, corresponding to respective zones classified by the engine speed $N_e$ and the intake air quantity Q, as shown in FIG. 26. $P_{ir(k)}$ is a target value which maximizes the average value of the indicated mean effective pressure, which is set beforehand based on an experimental value, converted into a data table, and memorized and set beforehand.

In next Step 126B, the difference $\Delta P_{i(k)(i)}$ between the current mean value of the indicated mean effective pressure $P_{i(k)AVz(i)}$ obtained in Step 124, and the target value of the indicated mean effective pressure $P_{ir(k)}$ which is read in Step 126A, is obtained. In Step 127, the absolute value of the difference $|\Delta P_{i(k)(i)}|$ is compared with the dead zone threshold value $|\Delta P_{is(k)}|$ which judges as the averaged indicated mean effective pressure being equal to the target value. This dead zone threshold value $|\Delta P_{is(k)}|$ is a predetermined value. In the following description of the embodiment, the difference between the averaged indicated mean effective pressure and the target value, $\Delta P_{i(k)(i)}$ is described simply as $\Delta P_{i(k)(i)}$, the absolute value thereof, $|\Delta P_{i(k)(i)}|$, and the dead zone threshold value $|\Delta P_{is(k)}|$, as $|\Delta P_{is(k)}|$. In Step 127, When $|\Delta P_{i(k)(i)}| > |\Delta P_{is(k)}|$, the operation goes to Step 128 for making the averaged indicated mean effective pressure close to the target value. When NOT $|\Delta P_{i(k)(i)}| > |\Delta P_{is(k)}|$, the averaged indicated mean effective pressure is judged as it reaches the target value, and the operation goes to Step 138.

In Step 128, a judgment is made on whether the treatment of making the average indicated mean effective pressure close to the target value, is made for the first time, or $I_{(k)}=0$. When $I_{(k)}=0$, the operation goes to Step 142, in which the air-fuel ratio change quantity $\Delta A/F$ is added to the preceding air-fuel ratio correction coefficient $C_{AF(k)(i-1)}$ or $\Delta A/F$ =RICH, and the value is made as the current air-fuel patio correction coefficient $C_{AF(k)(i)}$, and the operation goes to Step 134.

When $I(k)\neq 0$ in Step 128, in next Step 129, a judgment is made whether $\Delta P_{i(k)(i)}$ is equal to or more than $\Delta P_{i(k)(i-1)}$. For instance, when $P_{i(k)AvE(i)} \geqq p_{i(k)AVE(i-1)}$ and $\Delta P_{i(k)AVE(i)} \Delta P_{i(k)AvE(i-1)}$, the operation goes to Step 130, and a judgment is made on whether RICH flag $F_{r(k)}$ is ON. For instance, when $P_{i(k)AvE(i)} < P_{i(k)AVE(i-1)}$, the operation goes to Step 131, and a judgment is made on whether the RICH flag $F_{r(k)}$ is ON.

When the RICH flag $F_{r(k)}$ is OFF in Step 130, or when the RICH flag $F_{r(k)}$ is ON in Step 131, the operation goes to Step 133 and $C_{AF(k)(i)}=C_{AF(k)(i-1)}+\Delta A/F$, or $\Delta A/F$ =RICH, and further in Step 135, the RICH flag $F_{r(k)}$ is made OFF. After the treatment of Step 134 or 135, in next Step 136, $I_{(k)}$ is incremented as $I_{(k)}=I_{(k)}+1$.

In next Step 137, a calculation is made by using the determined $C_{AF(k)(i)}$ and following the equation (4), the fuel injection quantity $T_{p(k)}$ of No. K cylinder is obtained, which is set as an A/F control quantity, and the fuel injection is carried out.

On the other hand, the Step 138 is the case in which $P_{i(k)AVE(i)}$ agrees with $P_{ir(k)}$ The air-fuel ratio correction coefficient corresponding to the zone of an air-fuel ratio correction coefficient map, which is condition $N_{e(i)}$ and $Q_{(i)}$, and which is determined for respective cylinder, is renewed by $C_{AF(k)(i)}=C_{AF(k)(i-1)}$. Flag $F2_{(k)}$ is made as $F2_{(k)}=0$, and the operation treats next Step 137.

In this two-dimensional air-fuel ratio correction coefficient map, for instance, the value is set in the zone which is classified by the engine speed $N_e$ and the intake air quantity Q, is $C_{AF(k)}$ itself. Furthermore, this map is provided for respective cylinders, and in this embodiment, there are four kinds of map for four cylinders.

Furthermore, in Step 122, when the engine is not in steady state running condition, the operation goes to Step 140. $I_{(k)}$ is initialized as $I_{(k)}=0$. In Step 141, $C_{AF(k)(i)}$ which corresponds to the A/F control quantity for No. k cylinder in the zone of the running condition $N_{e(i)}$ and $Q_{(i)}$, is read from the two-dimensional map. This is the two-dimensional map shown in FIG. 27, which may be renewed by the operation of the above Step 138: In the running zone which is not renewed in Step 138, a predetermined initial value $C_{AF(k)}$ is stored. After that, Step 137.

After the treatment of Step 137, the operation is finished.

In the above the third embodiment, explanation is given to the case in which the air-fuel ratio is controlled. However, a control by the ignition timing may be made in FIG. 25, in which $C_{AF(k)(i)}$ is replaced with the advance angle value $SA_{(k)(i)}$, $\Delta A/F$ is replaced with $\Delta SA$, and so on. Furthermore, $F_{r(k)}=ON$, is replaced with "No. k cylinder advance", and $F_{r(k)}=OFF$ is replaced with "No. k cylinder retard". Furthermore, corresponding to the setting of the A/F control quantity which corresponds to $C_{AF(k)(i)}$, $SA_{(k)(i)}$ is set as the advance angle value (ignition timing).

Figure 28:
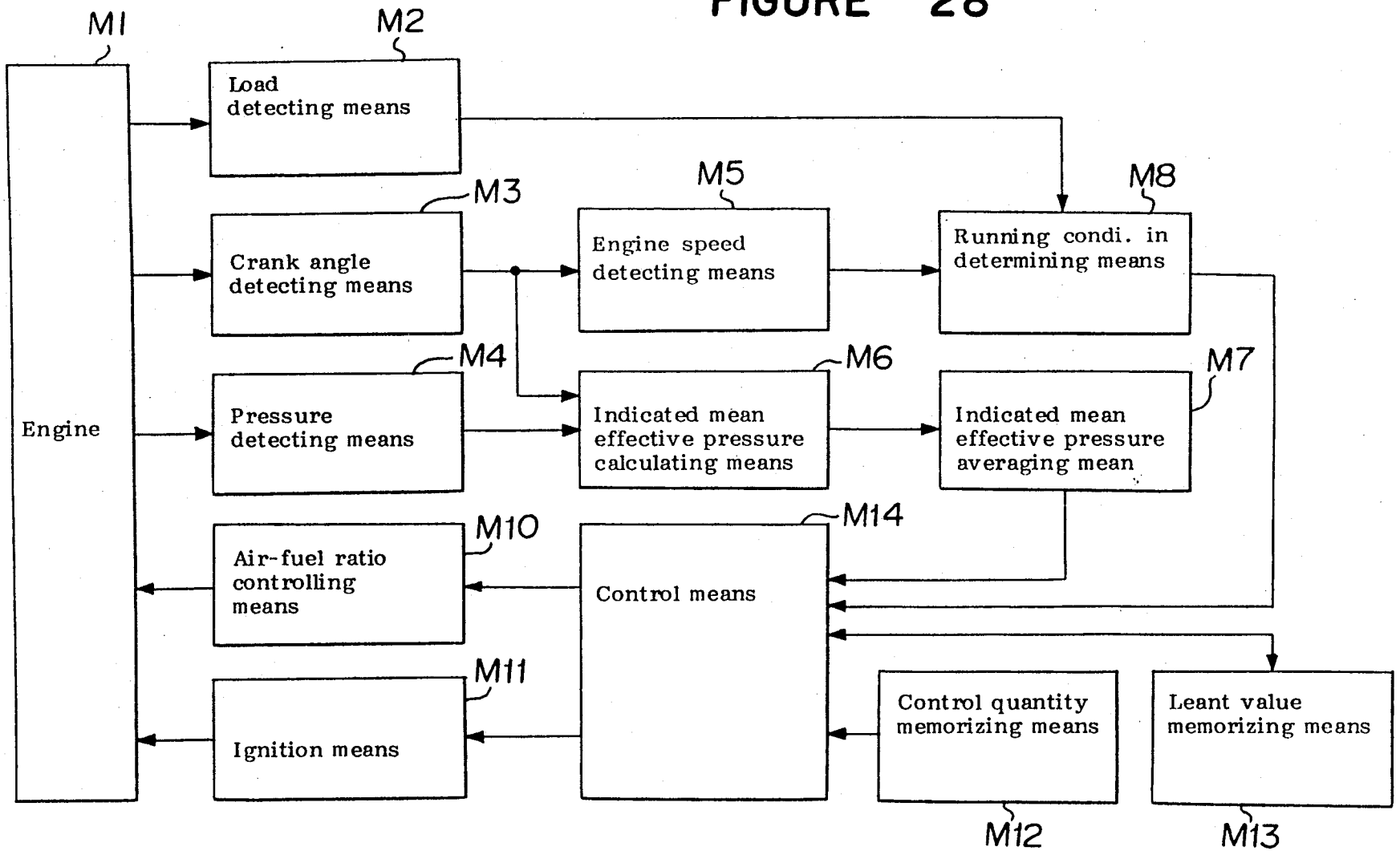
FIG. 28 is a block diagram showing the element and the function of important parts of a fourth embodiment of the control apparatus of the engine according to the present invention.

Next, explanation will be given to a fourth embodiment of the present invention. FIG. 28 is a block diagram showing the function of the structure of the important parts of this invention including the fourth embodiment of the invention. As is understood by comparing it with FIG. 5, Ml to M8, M10, and M11 performs the same function as in the first embodiment. However, in this invention, the embodiment of the invention may be concerned with one cylinder.

Accordingly, in the fourth embodiment, in using FIG. 1, the pressure sensor $19_{(k)}$ may be for only one cylinder for instance $19_{(1)}$, the other parts $19_{(2)}$ to $19_{(4)}$ in FIG. 4 are not necessary. The suffix$_{(k)}$ should be omitted for the part of the explanation overlapped with that in the first embodiment.

The control means M14 which is shown in FIG. 28, determines at least one of the air-fuel ratio and the ignition timing which maximize average value of the indicated mean effective pressure, when the engine Ml is in a predetermined running condition, which is determined by the output of the running condition determining means M8, and the output of the indicated mean effective pressure averaging means M7. The output of the control means M14 is given to the air-fuel ratio control means M10 and the ignition means M11, respectively. Furthermore, M12 is a control quantity memorizing means, which memorizes at least one control quantity or the related value of the air-fuel ratio and the ignition timing under a predetermined condition, and output the memorized value to the control means M14. Furthermore, M13 is a learnt value memorizing means, which memorizes at least one learnt value of the air-fuel ratio and the ignition timing which maximizes the average value of the indicated mean effective pressure that is determined by the control means M14. Furthermore, the control means M14, when the running condition of the engine Ml is in a predetermined running region, and when the control means can not control at least one of the air-fuel ratio and the ignition timing, which maximizes the average value of the indicated mean effective pressure, controls at least one of the air-fuel ratio and the ignition timing (in this embodiment the air-fuel ratio) by using the memorized value of the control quantity memorizing means M12, or the memorized value of the learnt value memorizing means M13.

Figure 29:
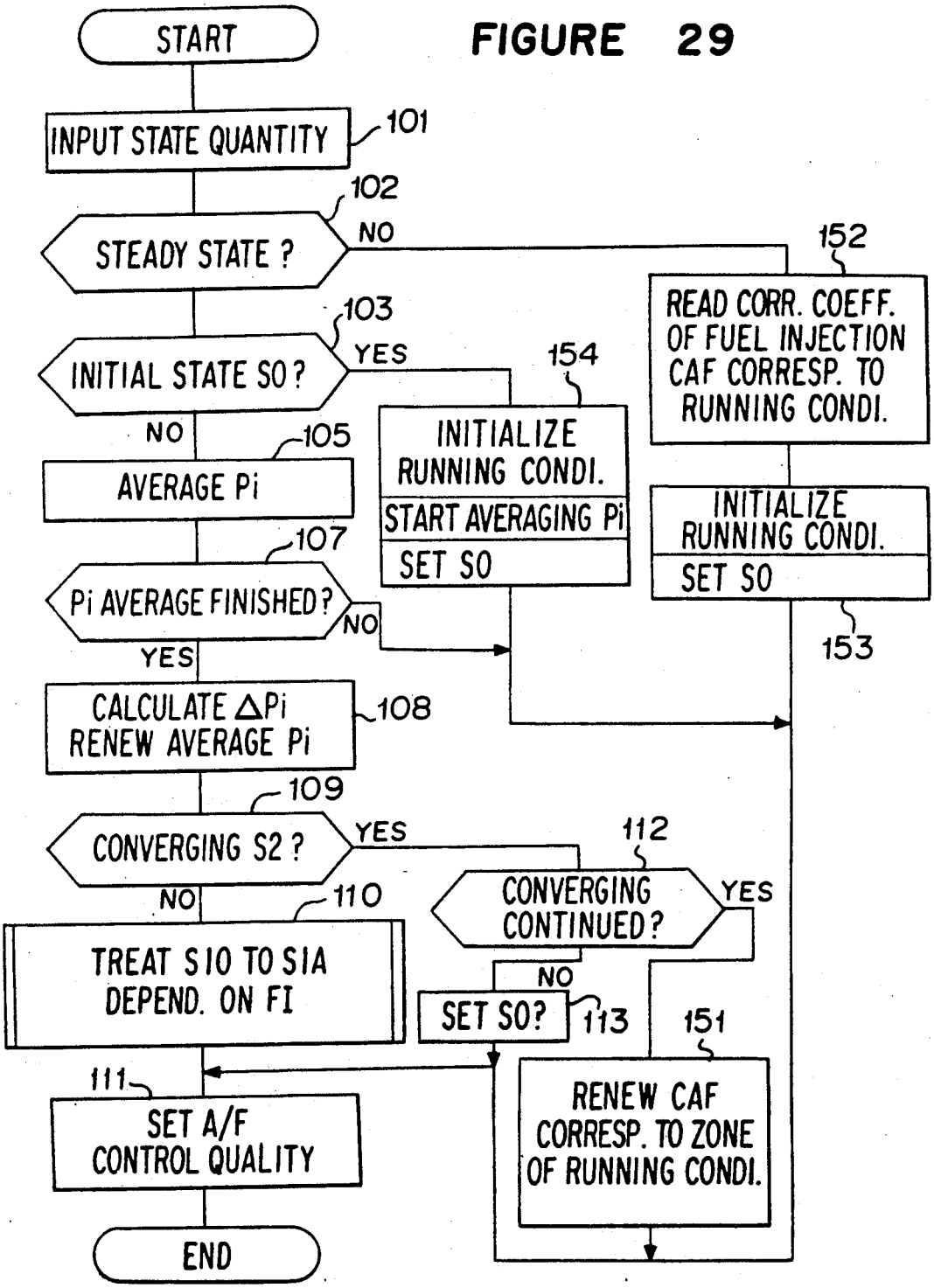
FIG. 29 is a flow chart showing the calculation treatment procedure in which the averaged value of the indicated mean effective pressure is maximized, for explanation of the fourth embodiment.

FIG. 29 is a flow chart of the fourth embodiment in lieu of FIG. 10 of the first embodiment. As for the treatment units which are the same or corresponding treatment units in FIG. 10, the same notations 101 to 103, 105, and 107 to 113 are attached, and the overlapped explanation is omitted. The flow chart in FIG. 29 is started as every 720° CA (every two revolutions of engine).

In Step 112, a judgment is made on whether the converging state is continued. When the converging state is continued, the operation goes to Step 151. In Step 151, the air-fuel ratio (A/F) control quantity is determined which maximizes the average value of the indicated mean effective pressure $P_i$ and the converging state is continued. In this state, the running condition is within a predetermined quantity of change. The running condition falls in a running zone which is classified and determined by the engine speed $N_e$ and detection air quantity Q as shown in FIG. 27. The operation learns and memorizes the air-fuel ration correction coefficient CAF which corresponds to the currently determined A/F control quantity, as the air-fuel ratio correction coefficient CAF which is utilized in the current running zone. This value is written by a memorizing device (RAM) which retains the value, so far as the microcomputer is not reset.

FIG. 27 applied to this embodiment, is a case in which for instance, the engine speed $N_e$ and the intake air quantity Q are selected as state quantities which determine the running condition. When the engine speed $N_{e(i)}$ and the intake air quantity $Q_{(i)}$ are determined, the running condition corresponds to one of the running zones classified in FIG. 27. For each running zone, one air-fuel ratio correction coefficient is given. As for the air-fuel ratio correction coefficient CAF, a predetermined value is set to each running zone as a initial value, when a treatment in the above Step 151 is not carried out. This value, for instance in the same type engine, may be a representative (or an averaged) value which maximizes the average value of the indicated mean effective pressure.

In Step 102, when a judgment is made as the running condition is not in steady state, the operation goes to Step 152. In Step 152, the air-fuel ratio correction coefficient CAF, which corresponds to the current running condition (the engine speed $N_{e(i)}$ and the intake air quantity $Q_{(i)}$) and which is given as a map value in the running zone given by FIG. 27, is read, and memorized.

In next Step 153, the current running condition is memorized as an initial state. The memorized state quantity becomes a standard state which determines whether the running condition is in steady state at next time. Flag $F1_{(k)}$ is set as S0, and the operation goes to Step 111.

In Step 103, when Fl = S0, the operation goes to Step 154. In Step 154, after the initialization of running condition value, the starting of the averaging of the indicated mean effective pressure, and setting of Fl =S10 are performed, the operation goes to Step 111.

Also in this case of the fourth embodiment, the control may be changed to the control of the ignition timing as in the above first embodiment.

In the above second to Fourth embodiments, the air flow meter may be substituted by a intake air pressure sensor, a throttle valve opening degree sensor, and so on.

In the above embodiment, in treating respective cylinders, the treatment is carried for all the cylinders of the engine. However, this treatment may be performed for the selected plurality of cylinders.

The indicated mean effective pressure may be obtained successively, for instance, at every 720° CA, for respective cylinders, not as in FIG. 23. The other various variations may be considered for the timing of the measurement.

As stated above, in this invention, under a predetermined running condition, at least one the air-fuel ratio and the ignition timing is controlled, so that an average value of the respective indicated mean effective pressures of a plurality of cylinders, or the value averaged among cylinders, is maximized, or so that the average value for the respective indicated mean effective pressures of a plurality of cylinders agree with respective target values, with a effect mentioned below. (1) As an actual output of the engine is measured and controlled by a feed back control, in any running condition, the engine can be controlled so that the output of the engine is always made to the target value. (2) In spite of the timewise change of the engine or the change of the characteristic of the air-flow meter or an injector, the engine can always be controlled so that the output of the engine agrees with the target value. (3) In case of plurality of cylinders the control quantity can always be set so that the outputs of the respective cylinders are balanced. Therefore smooth rotation of the engine or the silence of the engine can be obtained.

Moreover, under certain running condition of the engine, at least one of the air-fuel ration and the ignition timing is controlled so that the average value of the indicated mean effective pressure is maximized, and a learning is made. Therefore, in case that the control is not possible, the engine can be controlled by a predetermined memorized value or by the learnt value, with the effect mentioned below.

On top of the effects of the above (1) and (2), even if the initially set air-fuel ratio or the ignition timing is not at its optimum value, in utilizing the engine, a learning by a feed back control is carried out, so that after learning, a control is performed so that the output of the engine is maximized.

What is claimed is:

1. A control apparatus of an internal combustion engine which comprises:

a pressure detecting means for detecting an inner cylinder pressure of each cylinder of a plurality of cylinders of the internal combustion engine;

a crank angle detecting means for detecting a crank angle of the internal combustion engine;

indicated mean effective pressure calculating means for calculating an indicated mean effective pressure of each cylinder from an output of the pressure detecting means and an output of the crank angle detecting means;

load detecting means for detecting a load of the internal combustion engine;

engine speed detecting means for detecting the internal combustion engine speed from an output of the crank angle detecting means;

running condition determining means for determining a running condition of the internal combustion engine from an output of the load detecting means and an output of the engine speed detecting means; and averaging and controlling means for controlling at least one of an air-fuel ratio and an ignition timing independently for each cylinder, so that an average value of each indicated mean effective pressure of the plurality of cylinders is independently maximized, based on an output of the indicated mean effective pressure calculating means, under a predetermined running condition determined by the running condition determining means.

2. A control apparatus of an internal combustion engine which comprises:

a pressure detecting means for detecting an inner cylinder pressure of each cylinder of a plurality of cylinders of the internal combustion engine;

a crank angle detecting means for detecting a crank angle of the internal combustion engine;

indicated mean effective pressure calculating means for calculating and indicated mean effective pressure of each cylinder from an output of the pressure detecting means and an output from the crank angle detecting means;

load detecting means for detecting a load of the internal combustion engine;

engine speed detecting means for detecting the internal combustion engine speed from an output of the crank angle detecting means;

running condition determining means for determining a running condition of the internal combustion engine from an output of the load detecting means and an output of the engine speed detecting means; and averaging and controlling means for controlling at least one of an air-fuel ratio and an ignition timing, so that an average value of the indicated mean effective pressure which is averaged among the plurality of cylinders, is maximized, based on an output of the indicated mean effective pressure calculating means, under a predetermined running condition determined by the running condition determining means.

3. A control apparatus of an internal combustion engine which comprises:

pressure detecting means for detecting an inner cylinder pressure for each cylinder of a plurality of cylinders of the internal combustion engine;

crank angle detecting means for detecting a crank angle of the internal combustion engine;

indicated mean effective pressure calculating means for calculating an indicated mean effective pressure of each cylinder from an output of the pressure detecting means and an output of the crank angle detecting means;

load detecting means for detecting a load of the internal combustion engine;

engine speed detecting means for detecting the internal combustion engine speed from an output of the crank angle detecting means;

running condition determining means for determining a running condition of the internal combustion engine from an output of the load detecting means and an output of the engine speed detecting means; and averaging and controlling means for controlling at least one of an air-fuel ratio and an ignition timing independently for each cylinder, so that an averaging value of each indicated mean effective pressure of the plurality of cylinders becomes a predetermined target value, based on an output of the indicated mean effective pressure calculating means, under a predetermined running condition determined by the running condition determining means.

4. A control apparatus of an internal combustion engine which comprises:

pressure detecting means for detecting an inner cylinder pressure for each cylinder of a plurality of cylinders of the internal combustion engine;

crank angle detecting means for detecting a crank angle of the internal combustion engine;

indicated mean effective pressure calculating means for calculating an indicated mean effective pressure of each cylinder from an output of the pressure detecting means and an output of the crank angle detecting means;

load detecting means for detecting a load of the internal combustion engine;

engine speed detecting means for detecting the internal combustion engine speed from an output of the crank angle detecting means;

running condition determining means for determining a running condition of the internal combustion engine from an output of the load detecting means and an output of the engine speed detecting means; and averaging and controlling means for controlling at least one of an air-fuel ratio and an ignition timing, so that an average value of the indicated mean effective pressure is maximized, based on an output of the indicated mean effective pressure calculating means, under a predetermined running condition determined by the running condition determined means;

said averaging and controlling means memorizing a control quantity and a value related to the control quantity as learning values, and controlling at least one of an air-fuel ratio and an ignition timing utilizing at least one of memorized values or the learning values of the control quantity and the value related to the control quantity of a predetermined air-fuel ratio and an ignition timing, when the running condition of the internal combustion engine is in a predetermined running condition domain, and when at least one of the air-fuel ratio and the ignition timing can not be controlled, so that the average value of the indicated mean effective pressure is maximized.

* * * * *